US012326313B2

(12) United States Patent
Ader

(10) Patent No.: US 12,326,313 B2
(45) Date of Patent: Jun. 10, 2025

(54) FIREARM MAGAZINE ENGAGEMENT MECHANISMS AND RELATED TECHNIQUES

(71) Applicant: Henry RAC Holding Corp, Rice Lake, WI (US)

(72) Inventor: Geoffrey Louis Ader, Chetek, WI (US)

(73) Assignee: Henry RAC Holding Corp, Rice Lake, WI (US)

( * ) Notice: Subject to any disclaimer, the term of this patent is extended or adjusted under 35 U.S.C. 154(b) by 111 days.

(21) Appl. No.: 18/465,360

(22) Filed: Sep. 12, 2023

(65) Prior Publication Data

US 2024/0085130 A1 Mar. 14, 2024

Related U.S. Application Data

(60) Provisional application No. 63/406,045, filed on Sep. 13, 2022.

(51) Int. Cl.

| | |
|---|---|
| ***F41A 9/59*** | (2006.01) |
| ***F41A 9/69*** | (2006.01) |
| ***F41A 35/06*** | (2006.01) |

(52) U.S. Cl.

CPC ..... *F41A 9/59* (2013.01); *F41A 35/06* (2013.01); *F41A 9/69* (2013.01)

(58) Field of Classification Search

CPC ..... F41A 9/59; F41A 9/69; F41A 35/06

See application file for complete search history.

(56) References Cited

U.S. PATENT DOCUMENTS

| | | | | |
|---|---|---|---|---|
| 7,921,587 | B2 | 4/2011 | Mayberry | |
| 9,194,637 | B2 * | 11/2015 | Mather | F41A 17/38 |
| 9,541,340 | B2 * | 1/2017 | Fluhr | F41A 35/06 |
| 9,803,943 | B2 * | 10/2017 | Schafer | F41A 9/59 |
| 9,989,326 | B2 * | 6/2018 | Larson, Jr. | F41A 9/55 |
| 10,415,913 | B2 * | 9/2019 | Wyssen | F41A 35/06 |
| 11,536,531 | B1 * | 12/2022 | Geissele | F41A 35/06 |
| 2010/0281736 | A1 | 11/2010 | Mayberry et al. | |
| 2012/0255209 | A1 | 10/2012 | Klassen | |

(Continued)

FOREIGN PATENT DOCUMENTS

| | | |
|---|---|---|
| DE | 10 2012 019911 B4 | 7/2014 |
| EP | 2 992 290 B1 | 6/2018 |

OTHER PUBLICATIONS

International Search Report and Written Opinion mailed Jan. 10, 2024 for International Application No. PCT/US2023/032476.

(Continued)

*Primary Examiner* — Michelle Clement

(74) *Attorney, Agent, or Firm* — Wolf, Greenfield & Sacks, P.C.

(57) ABSTRACT

The techniques described herein relate to methods and apparatus for a magazine release for a firearm. The magazine release includes an arm configured to engage with a magazine on a first side of the magazine, and an actuator operatively coupled to the arm and configured to transition the arm from a first position to a second position when actuated, wherein in the first position the arm is engaged with the magazine to hold the magazine and in the second position the arm is disengaged from the magazine, wherein the actuator is configured to be accessible from both the first side of the magazine and a second side of the magazine opposite the first side.

20 Claims, 25 Drawing Sheets

(56) References Cited

U.S. PATENT DOCUMENTS

| | | | | |
|---|---|---|---|---|
| 2013/0269231 | A1 | 10/2013 | Pietrzyk | |
| 2014/0325886 | A1 | 11/2014 | Mather | |
| 2015/0316339 | A1 | 11/2015 | Young et al. | |
| 2016/0040956 | A1 | 2/2016 | Giannelli et al. | |
| 2018/0156556 | A1 | 6/2018 | Wyssen | |
| 2019/0212085 | A1 | 7/2019 | Wilkinson et al. | |
| 2020/0309476 | A1 | 10/2020 | Gibbens et al. | |
| 2021/0102767 | A1 | 4/2021 | Kastrun | |
| 2021/0270551 | A1 | 9/2021 | Underwood et al. | |
| 2022/0299284 | A1* | 9/2022 | Tasyagan | F41A 35/06 |
| 2024/0085130 | A1* | 3/2024 | Ader | F41A 17/38 |

OTHER PUBLICATIONS

[No Author Listed], Springfield Hellion: the VHS-2 Bullpup Comes to the US. Forgotten Weapons—YouTube. Jan. 14, 2022. https://www.youtube.com/watch?v=933flAYW4Z4 [last accessed Jul. 17, 2024], 5 pages.

[No Author Listed], AK47 Tactical Reload Drills. Polenar Tactical—Youtube. Jun. 26, 20126 https://www.youtube.com/watch?v=nYs9Umw-Owo [last accessed Jul. 17, 2024], 5 pages.

[No Author Listed], How an AK-47 works. Si vis pacem, para bellum—YouTube. Jan. 24, 2017. https://www.youtube.com/watch?v=kul8r1XxktA [last accessed Jul. 17, 2024], 7 pages.

Schwenke, M16 and AR-15—How firearms work! (Animation). YouTube. Feb. 23, 2019. https://www.youtube.com/watch?v=wM1BUIN30yU [last accessed Jul. 17, 2024], 20 pages.

* cited by examiner

800

FIREARM MAGAZINE ENGAGEMENT MECHANISMS AND RELATED TECHNIQUES

RELATED APPLICATION

This patent claims priority under 35 U.S.C. § 119(e) to U.S. Provisional Application No. 63/406,045, titled "FIREARM MAGAZINE ENGAGEMENT MECHANISMS AND RELATED TECHNIQUES," filed on Sep. 13, 2022, which is hereby incorporated by reference herein in its entirety.

TECHNICAL FIELD

The techniques described herein are generally related to firearm magazine mechanisms. More specifically, the techniques relate to firearm magazine engagement and release mechanisms.

BACKGROUND

Generally, a firearm is a device that is designed to expel a projectile (e.g., a bullet) through the barrel of the firearm upon activation of an explosive (e.g., gunpowder within a casing of a cartridge that also holds the bullet). Firearms often include a trigger configured to actuate a firing pin to strike a fuse (e.g., a primer) of the cartridge to action the explosive, which causes projectile(s) to be expelled through the barrel of the firearm. Such interaction of the firing pin to the fuse is often controlled by depressing the trigger. Firearms can be configured with removable magazines configured to hold one or more cartridges.

SUMMARY OF INVENTION

Some embodiments relate to a magazine release for a firearm. The magazine release includes an arm configured to engage with a magazine on a first side of the magazine, and an actuator operatively coupled to the arm and configured to transition the arm from a first position to a second position when actuated, wherein in the first position the arm is engaged with the magazine to hold the magazine and in the second position the arm is disengaged from the magazine, wherein the actuator is configured to be accessible from both the first side of the magazine and a second side of the magazine opposite the first side.

Some embodiments relate to a method of manufacturing a firearm, including assembling a magazine release for the firearm, the magazine release including an arm configured to engage with a magazine on a first side of the magazine, and an actuator operatively coupled to the arm and configured to transition the arm from a first position to a second position when actuated, wherein in the first position the arm is engaged with the magazine to hold the magazine and in the second position the arm is disengaged from the magazine, wherein the actuator is configured to be accessible from both the first side of the magazine and a second side of the magazine opposite the first side.

Some embodiments relate to a method of releasing a magazine from a firearm. The method includes actuating an actuator of a magazine release of the firearm, wherein the actuator is operatively coupled to an arm configured to engage with a magazine on a first side of the magazine, to move the arm from a first position to a second position, wherein: in the first position the arm is engaged with the magazine to hold the magazine and in the second position the arm is disengaged from the magazine; and wherein the actuator is configured to be accessible from both the first side of the magazine and a second side of the magazine opposite the first side.

There has thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and which will form the subject matter of the claims appended hereto. It is to be understood that the phraseology and terminology employed herein are for the purpose of description and should not be regarded as limiting.

BRIEF DESCRIPTION OF FIGURES

Various objectives, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1A:
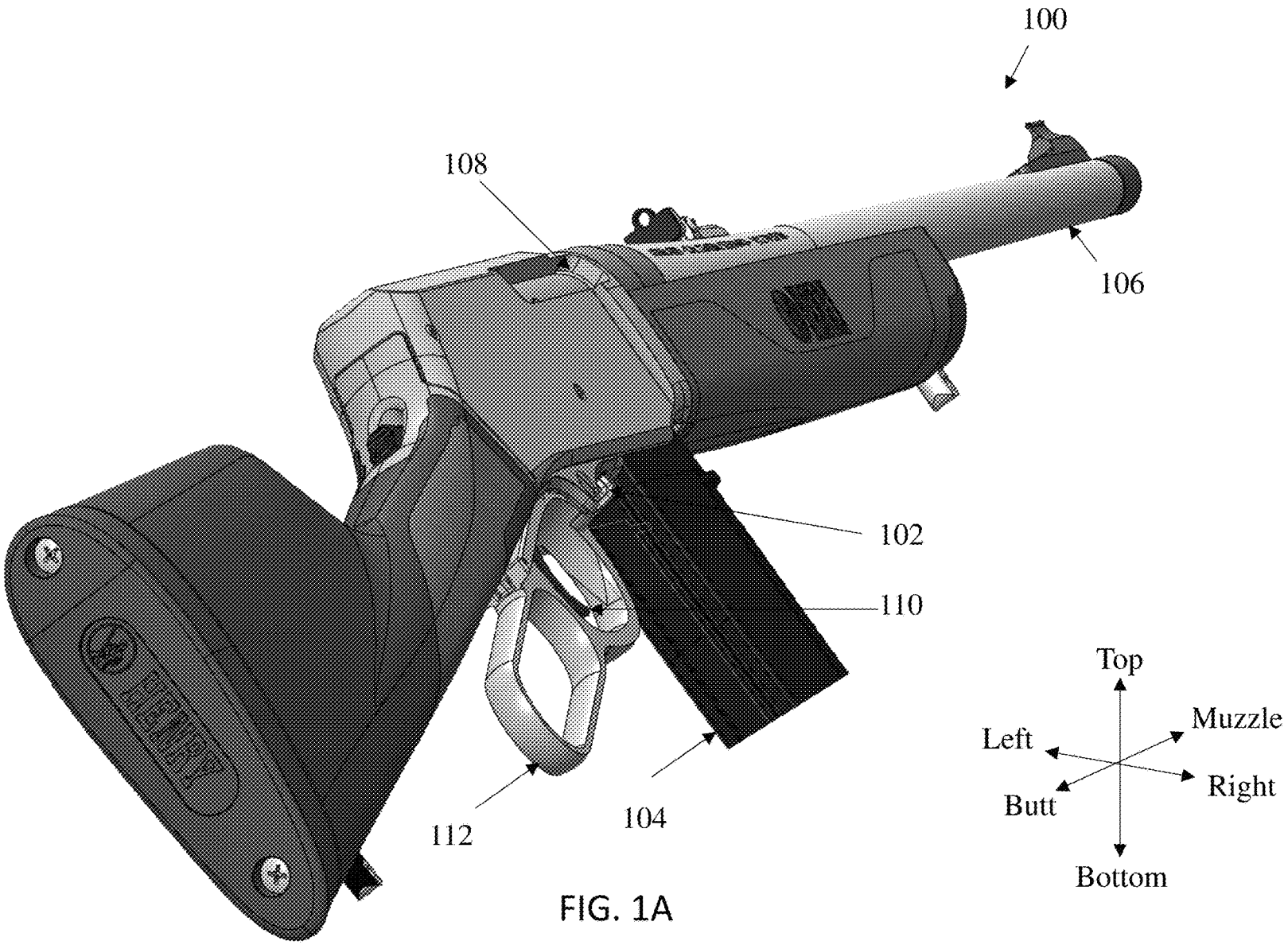
FIGS. 1A-1C are perspective diagrams of an exemplary lever-action firearm, according to some embodiments.

The techniques described herein provide for firearm magazine securing and release mechanisms that are disposed within a firearm. The securing and release mechanisms allow a firearm user to secure and release a removable magazine from the firearm via mechanical interaction of the mechanism with the removable magazine. In a first configuration, the magazine release mechanism is configured to secure the magazine within the firearm receiver (e.g., for firing the firearm). In a second configuration, the release mechanism is configured to allow for the release and removal of the magazine from the firearm (e.g., to reload the firearm). In some examples described herein, the techniques will be referred as a magazine release mechanism generally, without intending to be limiting.

The inventors have appreciated deficiencies with conventional magazine release mechanisms. Various types of firearms, such as AR15s, M4 Carbines, M16s, and others, have magazine release mechanisms that are disposed on the side of the firearm. Such release mechanisms are typically actuated by the user by pushing a button or flipping a switch on the side of the firearm (e.g., on the shooter's right side of the firearm). However, since such mechanisms or buttons are disposed on the side of the firearm, the user is required to use a particular hand to actuate the magazine release (e.g., the user's right hand), or to reach around the firearm to use the other hand (e.g., the user's left hand). Even if such release mechanisms were disposed on both sides of the firearm, it can be difficult for a user to actuate the magazine release. For example, the user may need to remove their gaze from the target and/or scene in front of the user in order to locate the position of the magazine release.

While some conventional approaches provide magazine releases that are located at a central position of the firearm, such approaches are typically limited to certain types of magazines, such as magazines with notches that extend outwards from the front or rear of the magazine. Accordingly, such approaches are not able to be used with other types of magazines, such as magazines with component(s) on the side of the magazine that are used to mechanically secure (and release) the magazine from the firearm.

The techniques described herein address these and other deficiencies. The techniques provide for a centrally-located magazine release mechanism that is configured to mechanically engage and disengage with a side portion of the removable magazine. In some embodiments, the magazine release includes a side catch or side arm that is configured to engage with the side of the magazine (e.g., the user's left or right side of the magazine when the magazine is inserted within the receiver). The magazine release includes an actuator that is operatively coupled to the first arm and configured to transition the arm from a first position at which the arm is engaged with the magazine to hold the magazine within the firearm, and a second position where the arm is disengaged from the magazine and allowing removal of the magazine. The actuator is configured to be accessible from both the first side of the magazine and a second side of the magazine opposite the first side.

The techniques described herein can therefore use a side catch to retain the magazine during operation, and provide a release actuator behind the magazine at a central location of the firearm. Using a side catch that is actuated by a central release mechanism can allow magazines with component(s) on the side of the magazine that are used to secure/release the magazine (e.g., AR magazines, which are among the most common magazines) to be used with a centrally-disposed magazine release. Due to its central location behind the magazine, the user can choose to use either hand to interact with the release. Additionally, a user can easily operate the release mechanism without needing to remove their gaze from the target and/or scene in front of them.

In the following description, numerous specific details are set forth regarding the systems and methods of the disclosed subject matter and the environment in which such systems and methods may operate, etc., in order to provide a thorough understanding of the disclosed subject matter. In addition, it will be understood that the examples provided below are exemplary, and that it is contemplated that there are other systems and methods that are within the scope of the disclosed subject matter.

Figure 1B:
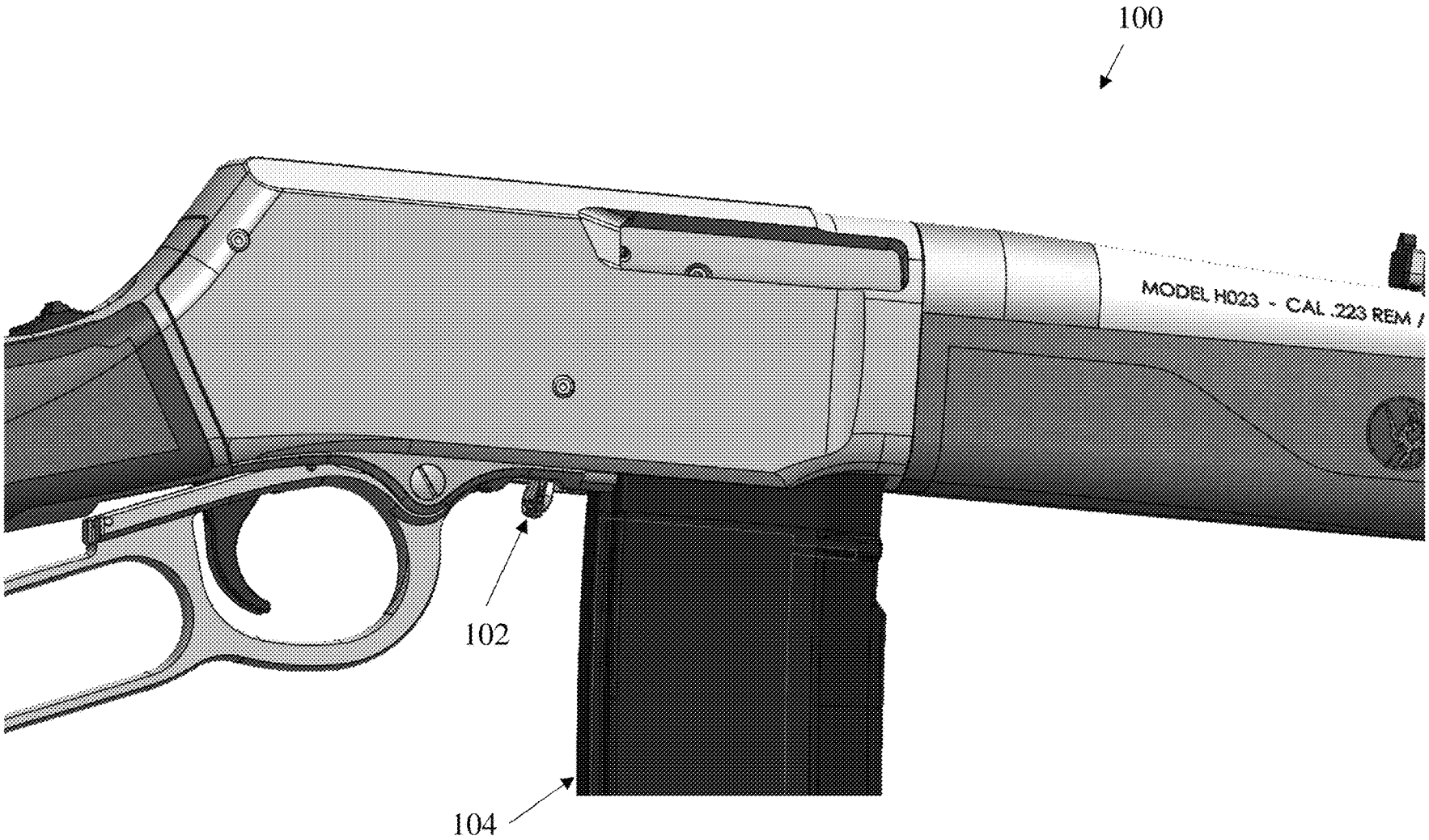
Figure 1C:
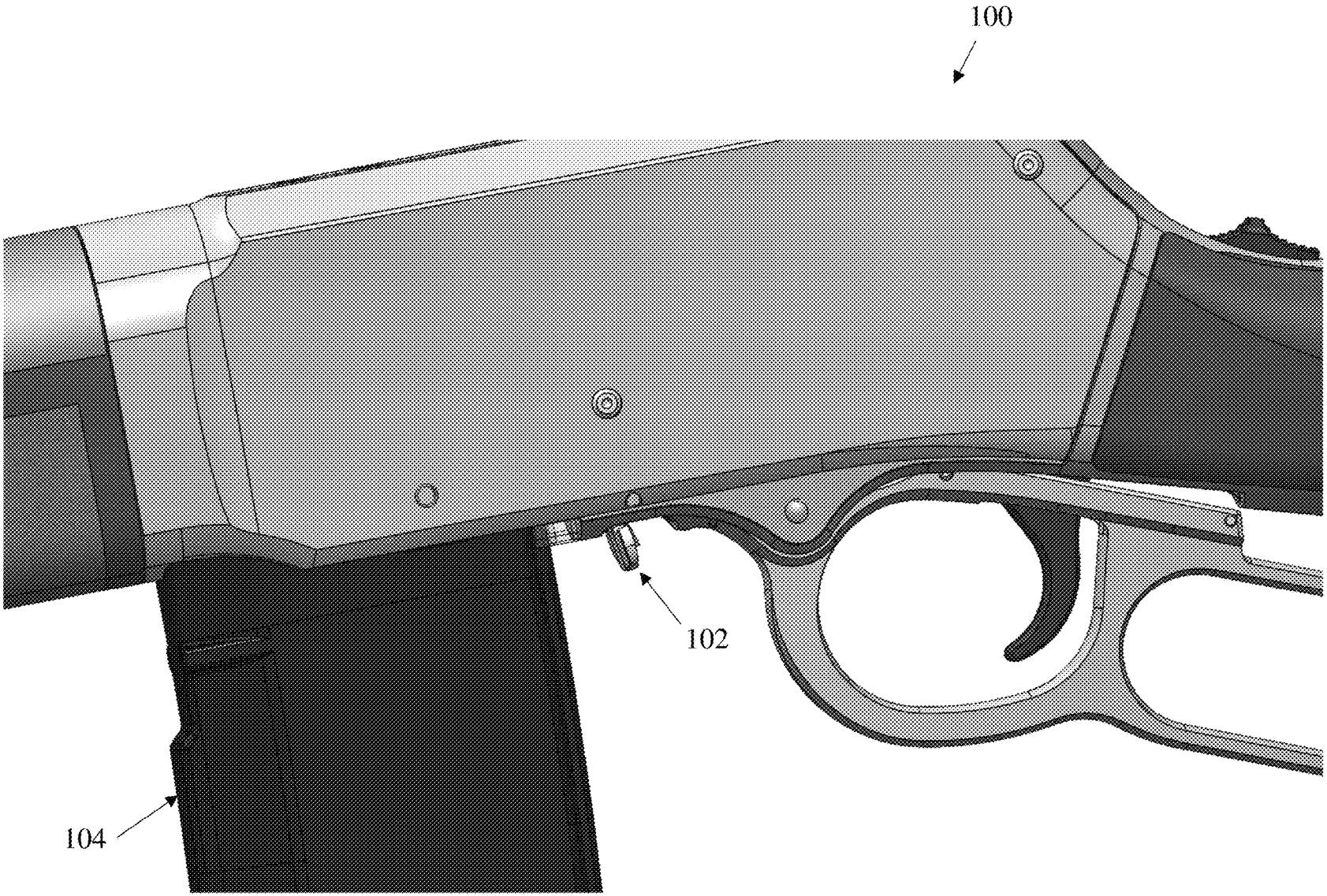

FIGS. 1A-1C are perspective diagrams of an exemplary lever-action firearm 100, according to some embodiments. The firearm 100 includes a magazine 104 that can be loaded into (and released from) the firearm 100. The magazine 104 is configured to hold a set (e.g., five, ten, fifteen, twenty, thirty, etc.) of cartridges (not shown) for use with the firearm 100. Each cartridge includes a casing (or shell, such as in the case of a shotgun), one or more projectile(s) disposed at a proximal end of the casing (e.g., a bullet, shot, slug, etc.), a fuse disposed at a distal end of the casing, and an explosive disposed within a portion of the casing between the fuse and the projectile(s). The firearm 100 also includes a magazine release assembly that includes a release actuator 102 that is visible in FIGS. 1A-1C. As explained further herein, the user can actuate the release actuator 102 by pushing the release actuator 102 in a direction from the butt of the firearm 100 towards the muzzle of the firearm 100 to release the magazine 104 from the firearm 100. Given the central location of the release actuator 102, a user can actuate the release actuator 102 using either their left and/or right hand, thus providing for easy, ambidextrous release of the magazine 104 from the firearm 100.

The firearm 100 further includes a barrel 106 and a chamber 108 (not visible, internal to the barrel) disposed adjacent to the barrel and sized to receive a cartridge. The firearm 100 includes lever 112 that, when actuated by the user, loads a cartridge into the chamber 108 (not visible, internal to the barrel) and/or unloads a cartridge from the chamber. The firearm 100 also includes a firing pin assembly and firing pin (not shown) that is mechanically actuatable by the trigger 110, such that upon actuation, the firing pin is configured to contact the fuse of the cartridge loaded into the chamber 108 to ignite the explosive and to cause the projectile(s) to be expelled through the barrel 106 of the firearm 100.

Figure 2A:
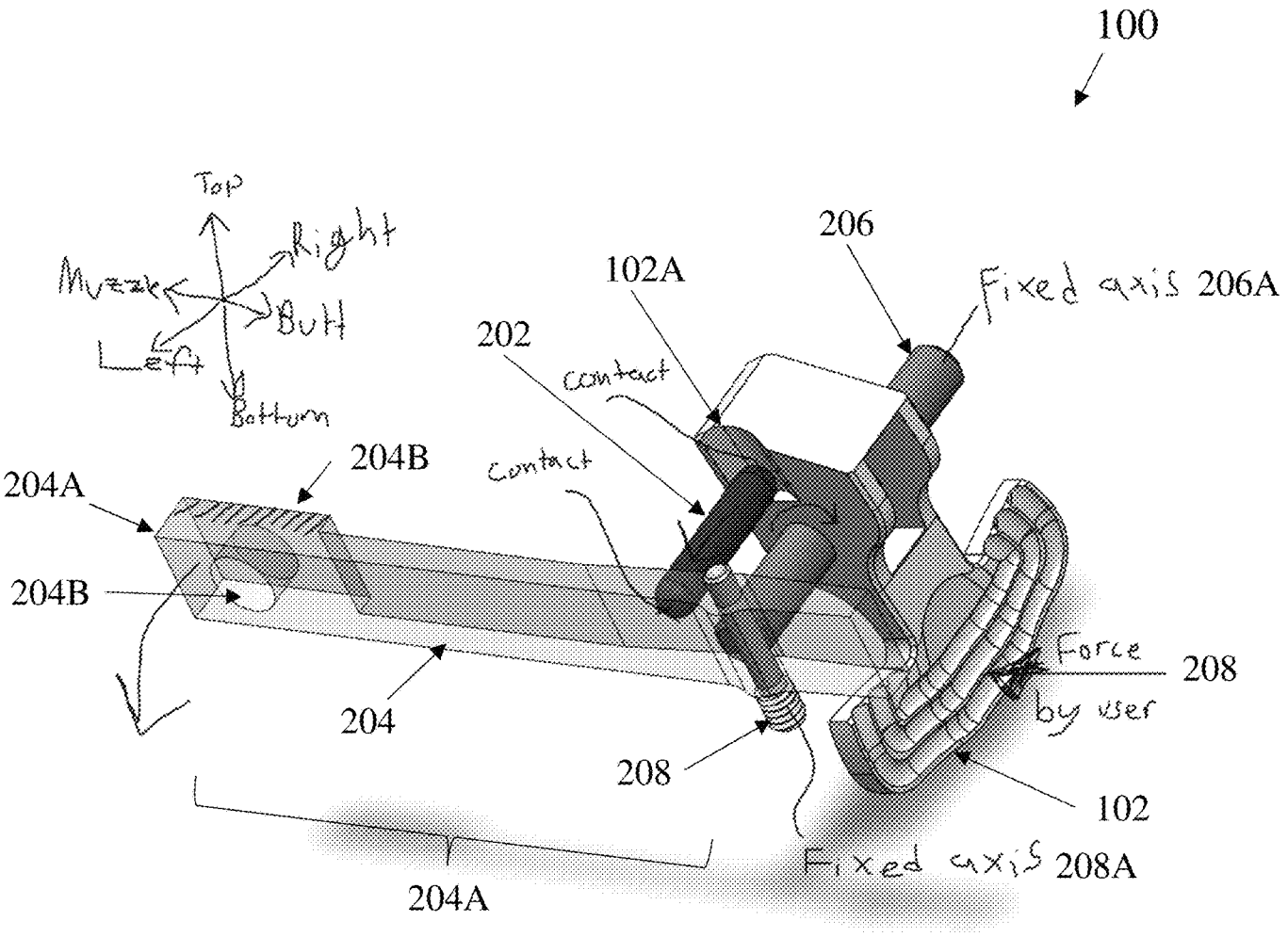
FIGS. 2A-2B are perspective diagrams of exemplary components of a magazine release assembly, according to some embodiments.
Figure 2B:
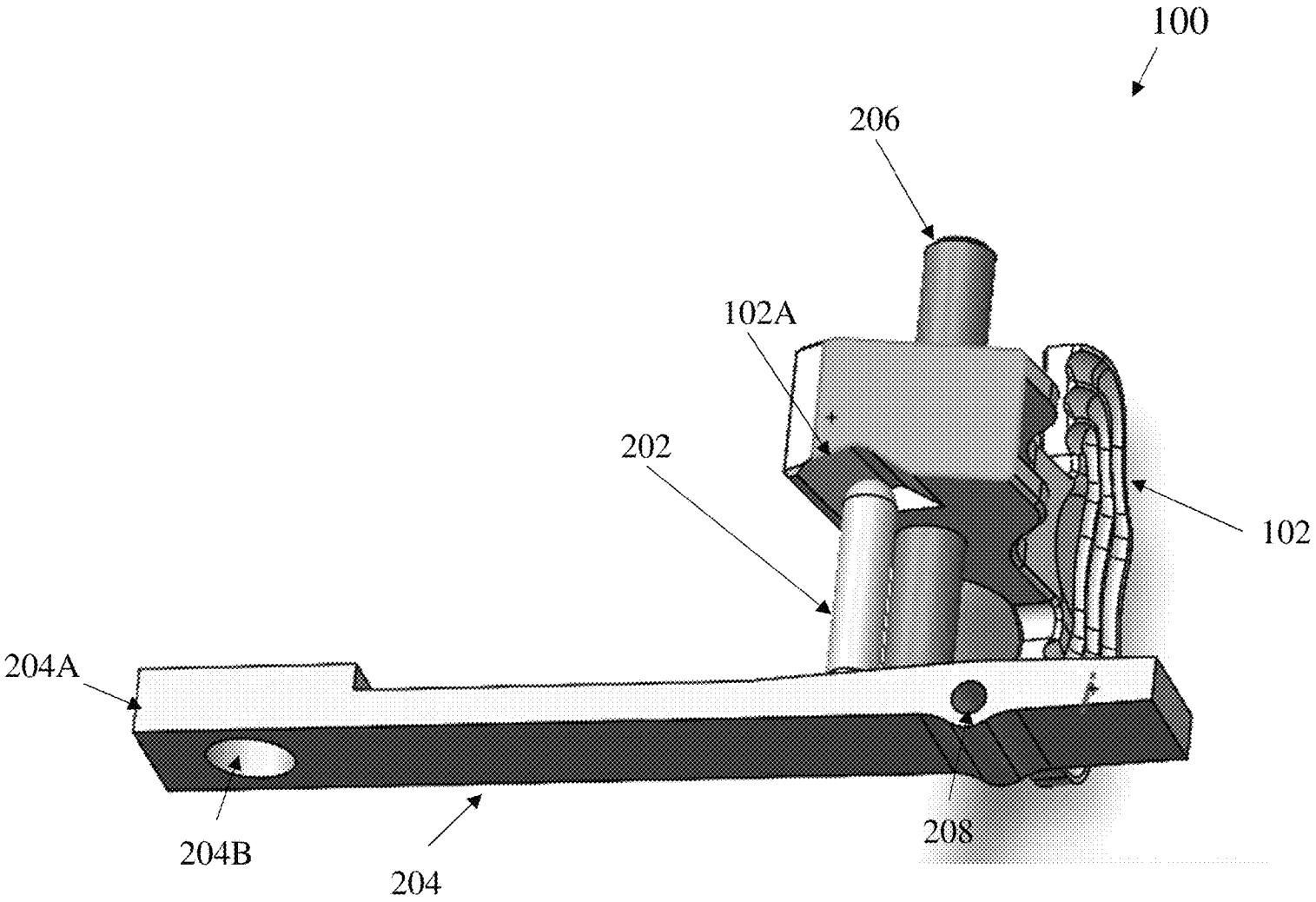

FIGS. 2A-2B are perspective diagrams of exemplary components of a magazine release assembly, according to some embodiments. FIGS. 2A-2B show the release actuator 102, catch plunger 202, side magazine catch 204, a first pin 206 and a second pin 208. The release actuator 102 can be biased towards a resting position in the direction of the butt of the firearm. At this position, an inserted magazine can be secured within the firearm. As shown in FIGS. 2A-2B, the release actuator 102 can include a textured surface that is configured to grip a user's thumb or finger as the user presses the release actuator 102 towards the muzzle end of the firearm (away from the user). A user presses the release actuator 102 in the direction indicated by the arrow (in FIG. 2A) 208, such that the user exerts a force on the bottom portion of the release actuator 102 in a direction from the butt of the firearm towards the muzzle. The exerted force causes the upper portion of the body of the release actuator 102 to rotate around the fixed axis 206A provided by the first pin 206 towards the butt of the firearm. The first pin 206 connects the release actuator 102 to the firearm such that the release actuator 102 moves/rotates with respect to the main body of the firearm.

In this illustrative embodiment, the catch plunger 202 is a pin with domed ends on both sides of the pin. The catch plunger 202 is configured to transmit, upon a user actuating the release actuator 102, a force to the side catch 204 via a v-shaped groove 102A formed in the top of the release actuator 102. In particular, the domed end of the pin disposed proximate to the v-shaped groove 102A such that the domed end cams in the groove 102A: as the bottom portion of the release actuator 102 is pushed away from the shooter towards the muzzle of the firearm, the top portion of the release actuator 102 rotates in the opposite direction and pushes the catch plunger 202 away from the magazine (towards the left of the shooter, in this example). As the catch plunger 202 is forced way from the magazine, the catch plunger 202 maintains contact with the side catch 204, pushing the front portion 204A of the side catch 204 away from the magazine (e.g., to the shooters left, in this example) about the fixed axis 208A provided by the second pin 208. Biasing the front portion 204A away from the magazine disengages the side catch 204 from the magazine 104, allowing removal of the magazine (e.g., such that the magazine can drop downwards and/or spring downwards if loaded with a force).

Figure 3:
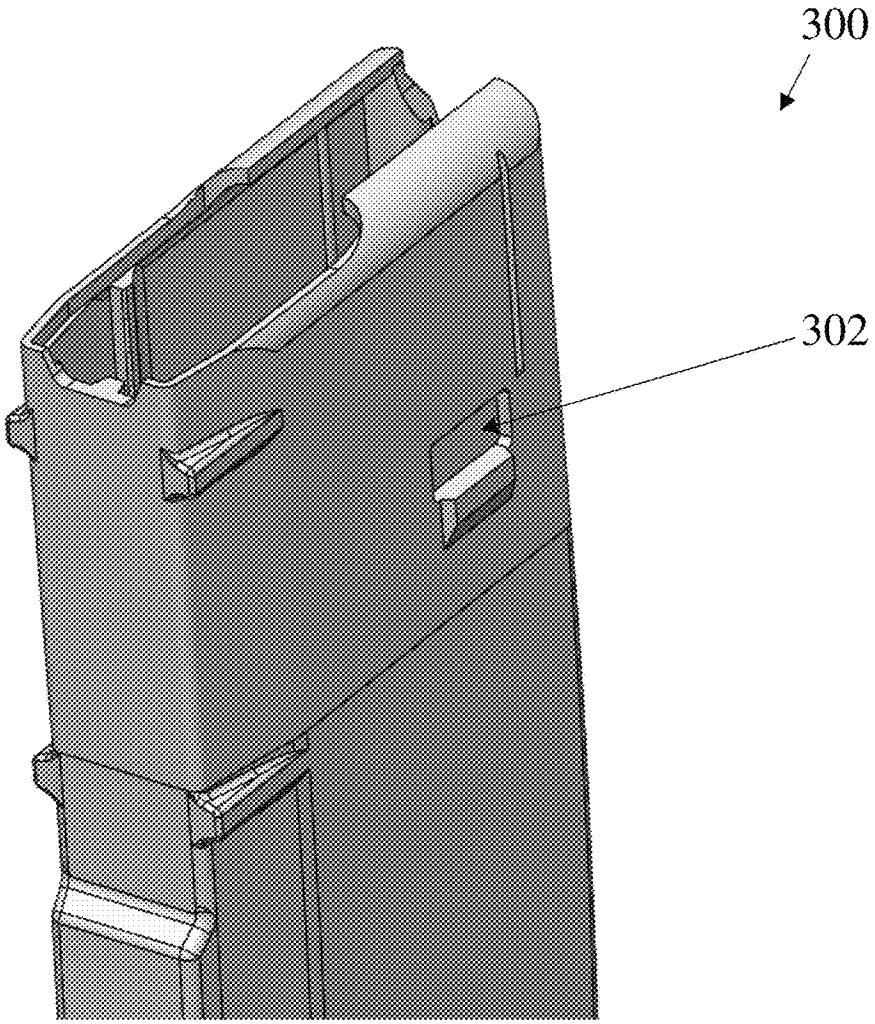
FIG. 3 is a perspective diagram of an exemplary magazine, according to some embodiments.

In some embodiments, the side catch 204 is engaged with a component of the magazine, such as a notch, inset, tab, and/or other component of the magazine. FIG. 3 is a perspective diagram of an exemplary magazine 300, according to some embodiments. The magazine 300 includes notch 302 that can engage with the extended portion 204B of the side catch 204 to mechanically secure the magazine 300 within the firearm. Therefore, the side catch 204 is biased away from the magazine 300 upon actuation of the release actuator 102 to allow for removal of the magazine 300 from the firearm. In some embodiments, the magazine 300 may drop out of the firearm (e.g., due to a gravitational force on the magazine 300). In some embodiments, the magazine 300 may be spring-loaded into the firearm (e.g., via a component of the magazine 300 (not shown in FIG. 3), and/or by a component of the firearm). Accordingly, upon actuation of the release actuator 102, the magazine 300 may begin to move outwards from the firearm to promote release of the magazine 300. Such a spring-loaded configuration can, for example, avoid a de-actuation of the release actuator 102 from re-engaging with the magazine 300 and preventing removal of the magazine 300.

In some embodiments, components of the magazine release mechanism may be disposed in one or more components of the firearm. For example, in some embodiments the release actuator 102 and the catch plunger 202 can be housed within the trigger guard of the firearm, while the side catch 204 can be housed within the receiver of the firearm. However, it should be appreciated that various configurations can be used to carry out the techniques described herein, and therefore the techniques are not so limited.

In some embodiments, the side catch 204 is biased towards the magazine. In the example shown in FIGS. 2A-2B, a pocket 204B in the side catch 204 can be used to house a spring and/or other biasing mechanism that biases (or pushes) the side catch 204 into contact with the magazine when the magazine is inserted into the receiver (e.g., into the notch in the shooter's left side of the magazine).

In some embodiments, the release actuator 102 can be biased towards the butt of the firearm. For example, in some embodiments, the magazine release mechanism may include a spring (e.g., a torsion spring) and/or other biasing mechanism that biases the textured portion of the release actuator 102 to its rearmost position (e.g., closest to the butt of the firearm, at which position the magazine remains secured within the firearm by the side catch 204).

It should be appreciated that while FIGS. 2A-2B show an exemplary configuration of the magazine release mechanism, this is intended to be for illustrative purposes and not to be limiting. It should be appreciated that various other mechanical configurations and/or components can be used to achieve the techniques described herein. For example, for magazines with notches and/or securing mechanisms on other sides of the magazine (e.g., on the shooters right side of the magazine), the components can be configured to engage on the right side of the magazine and/or on both sides of the magazine in contact with such notches and/or securing mechanisms. For example, a second catch plunger and side catch can be disposed on the other side of the release actuator 102 to provide mechanical interaction with both sides of the magazine. As a further example, the magazine release mechanism can be configured to contact the magazine in multiple locations (e.g., both (a) a left or right side of the magazine and (b) a rear/front of the magazine), as discussed further herein. As another example, other groove shapes and/or component configurations can be used to bias the side catch away from the magazine. Accordingly, the magazine release mechanism can be configured based on the firearm and/or aspects of the magazine (e.g., location(s) of securing portions of the magazine).

Figure 4A:
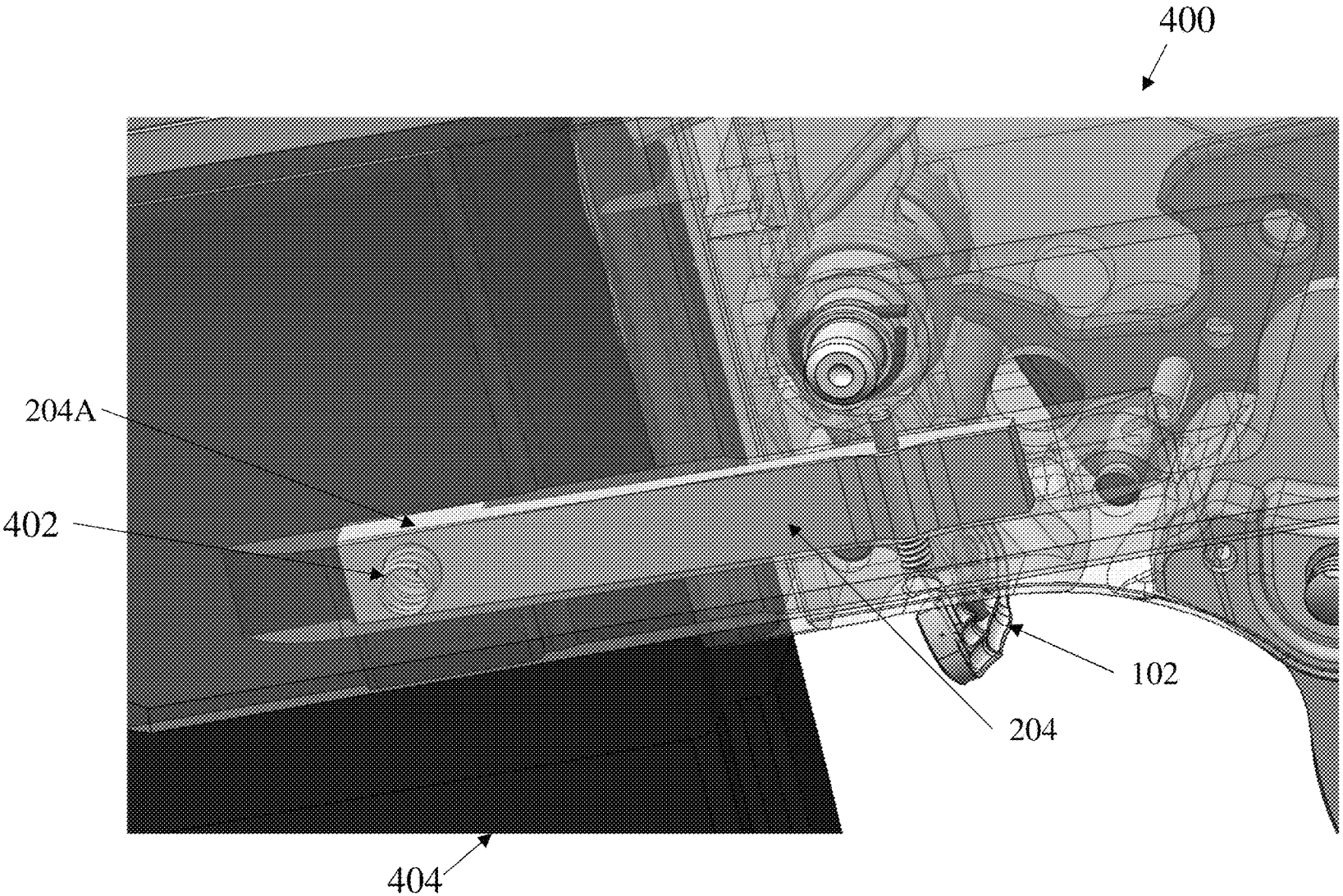
FIGS. 4A-4B show exemplary components of a magazine release mechanism in a first configuration that is engaged with the magazine, according to some embodiments.
Figure 4B:
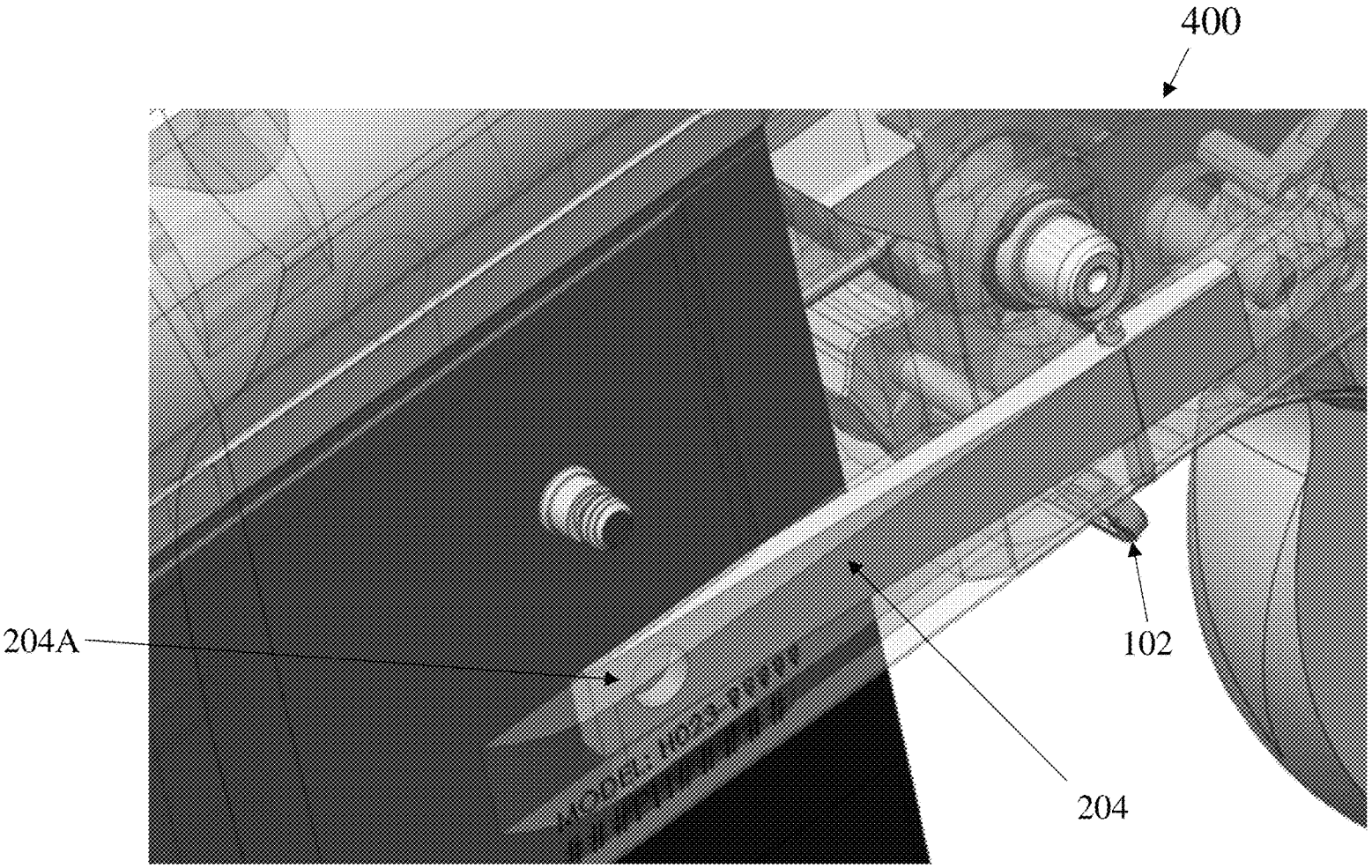

FIGS. 4A-4B show different perspective views of the components of a magazine release mechanism in a first configuration 400 where the magazine release mechanism is engaged with the magazine and thus securing the magazine within the firearm, according to some embodiments. In the first configuration 400, the release actuator 102 is biased backwards to a rear-most position towards the butt of the firearm (e.g., via a spring or other force, not shown). The spring 402 biases the side catch 204 from the side of the receiver towards the magazine 404. Accordingly, the extended portion 204B of the front portion 204A of the side catch 204 is pressed inwards into a groove of the magazine 404, securing the magazine 404 within the receiver of the firearm.

Figure 5A:
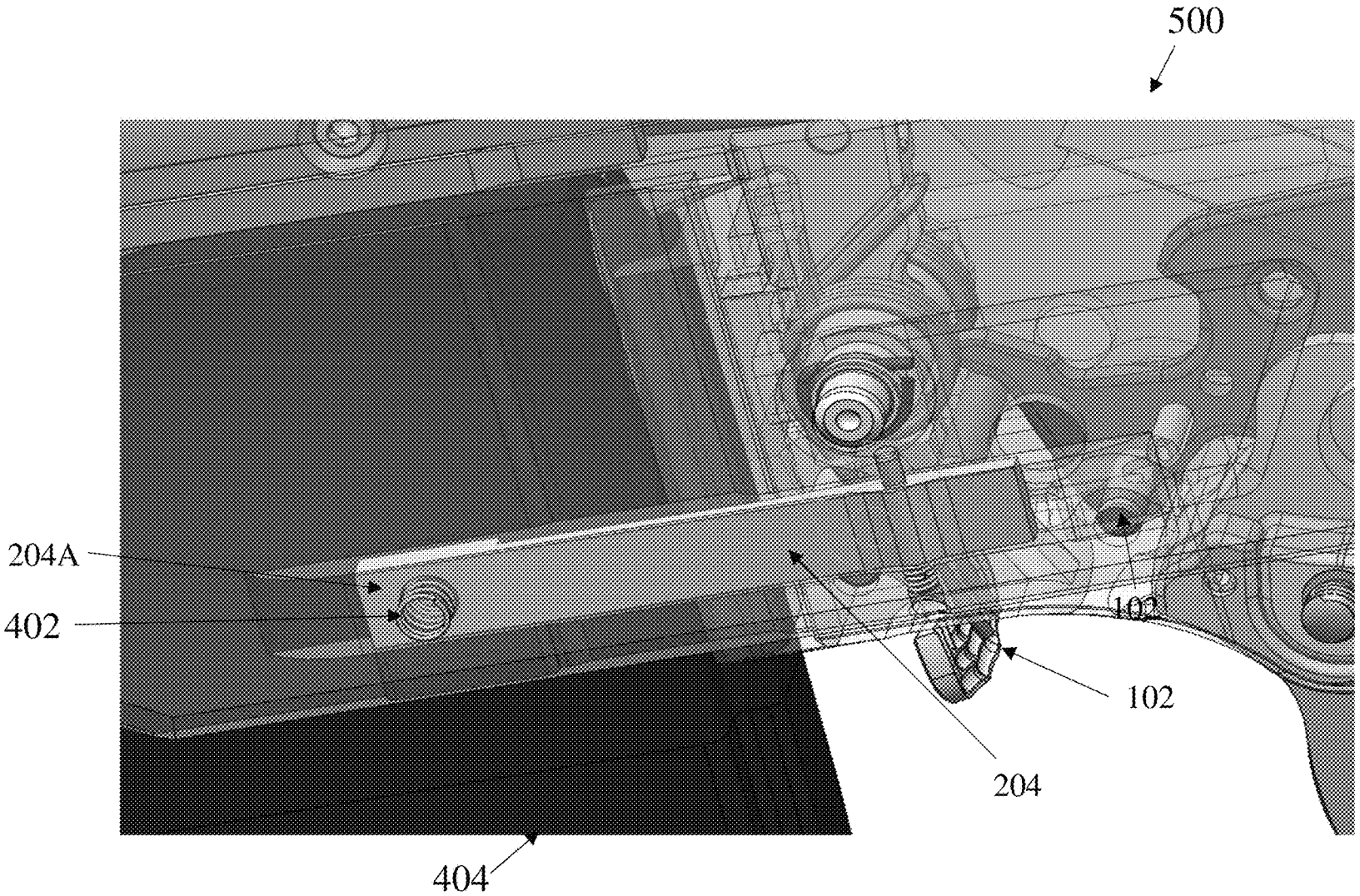
FIGS. 5A-5B show exemplary components of a magazine release mechanism in a second configuration that is disengaged from the magazine, according to some embodiments.
Figure 5B:
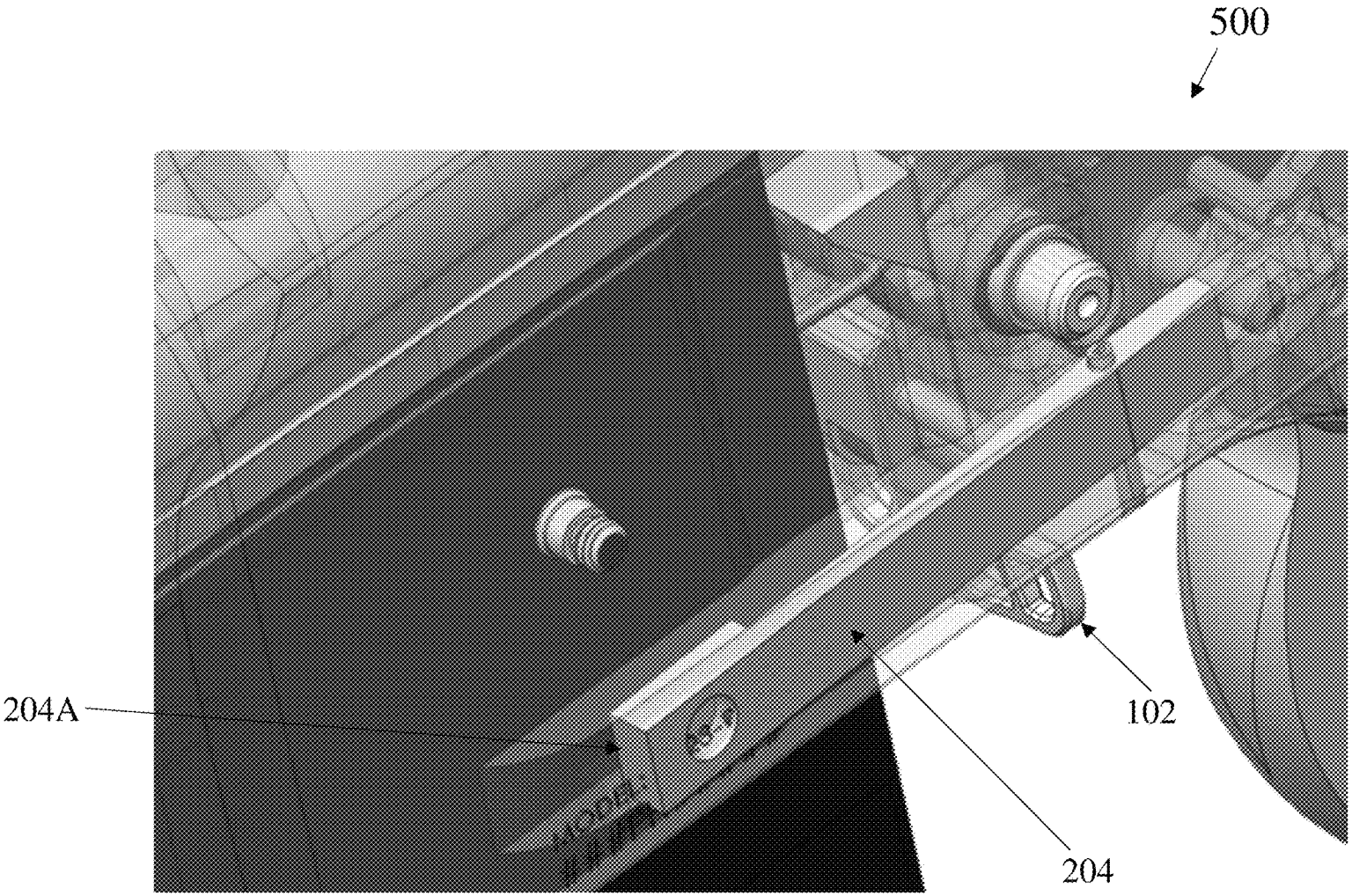

FIGS. 5A-5B show different perspective views of the components of a magazine release mechanism in a second configuration 500 where the magazine release mechanism is disengaged from the magazine to allow for removal of the magazine from the firearm, according to some embodiments. In the second configuration 500, the release actuator 102 is biased towards the muzzle of the firearm to a front-most position. As a result, as discussed in conjunction with FIGS. 2A-2B, the side catch 204 is forced towards the side of the receiver and away from the magazine 404. Accordingly, the extended portion 204B of the front portion 204A of the side catch 204 is removed from the groove of the magazine 404, releasing the mechanical contact of the magazine release mechanism from the magazine 404. In some embodiments, when mechanical contact of the magazine release mechanism is removed from the magazine 404, can drop freely from the firearm. In some embodiments, as described herein, when the magazine release mechanism is moved from the first configuration 400 to the second configuration 500, the magazine 404 can be spring-loaded such that the magazine 404 begins to push outwards from the receiver. Accordingly, when the release actuator 102 returns back to a rear-most position to return to the first configuration 400 (e.g., since the release actuator 102 is biased towards the rear-most position), the side catch 204 will not re-engage with the magazine 404.

As described herein, various configurations can be used for the magazine release mechanism. In some examples, the magazine release mechanism can be designed and/or configured to engage with the magazine based on the type and/or configuration of the magazine (e.g., an Armalite rifle (AR) magazine, automatic Kalashnikov (AK) magazine, etc.). In some embodiments, the magazine release mechanism can be configured to engage with a front and/or rear of the magazine (e.g., in addition to, or instead of, one or more sides of the magazine). For example, the forwardmost top surface of the release actuator can be configured to mechanically interact with a feature on the rear of the magazine, such as an AK magazine and/or other magazines with rear component(s) that can be used to secure the magazine within the firearm.

Figure 6A:
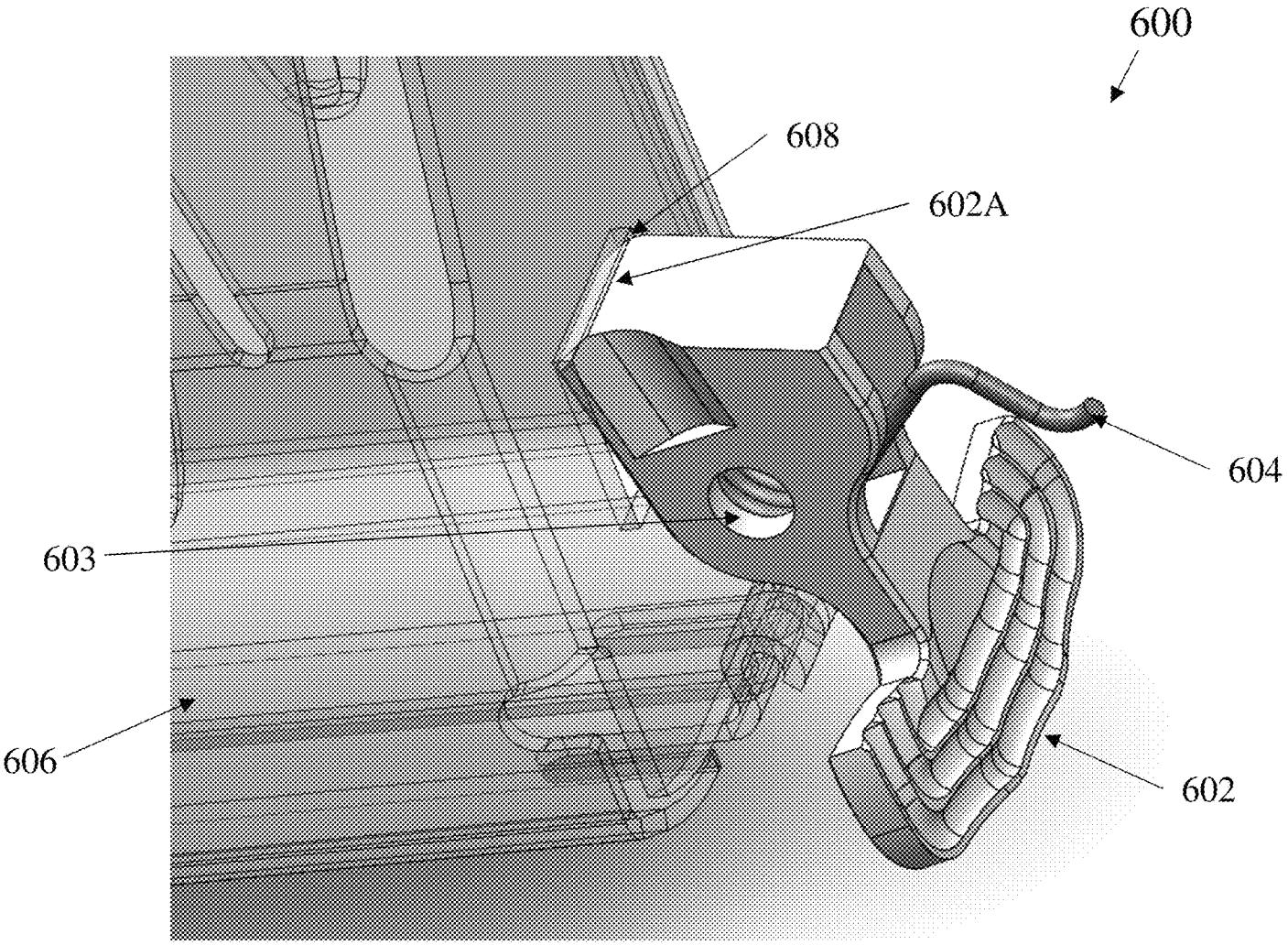
FIGS. 6A-6B show exemplary components of a rear-engaging magazine release in a first configuration that is engaged with the magazine, according to some embodiments.
Figure 6B:
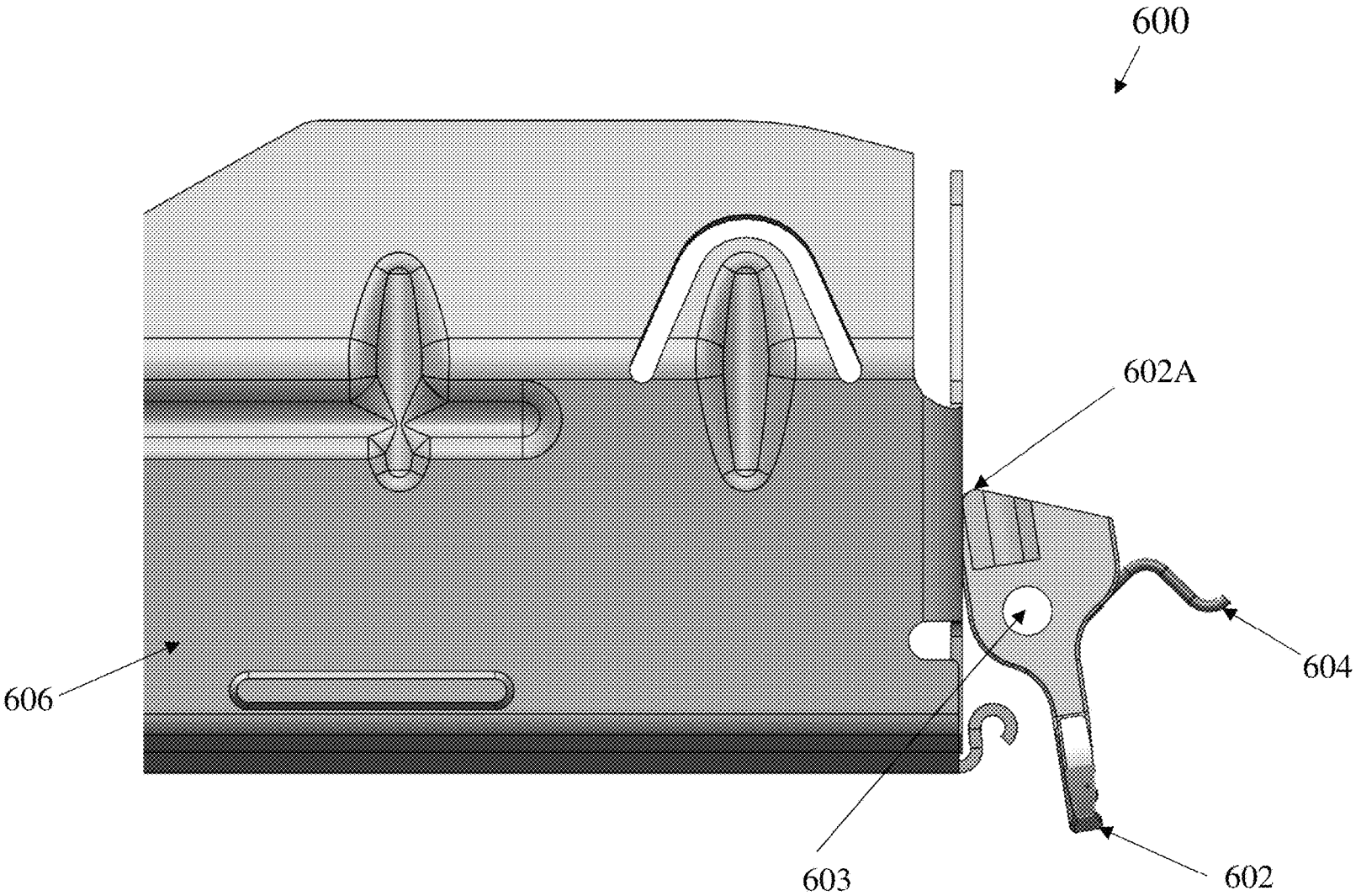

FIGS. 6A-6B show exemplary components of a rear-engaging magazine release in a first configuration 600 that is engaged with the magazine, according to some embodiments. The release actuator 602 can be biased towards the butt of the firearm via spring 604 about a fixed axis 603 (e.g., created by a pin, not shown in FIGS. 6A-6B). Accordingly, the resting position of the release actuator 602 is as shown in the first configuration 600. The magazine 606 includes a notch 608 on the rear side of the magazine 606 (towards the butt of the firearm/back of the user). The upper portion 602A of the release actuator 602 is disposed within the notch 608, securing the magazine 606 within the receiver of the firearm.

Figure 7A:
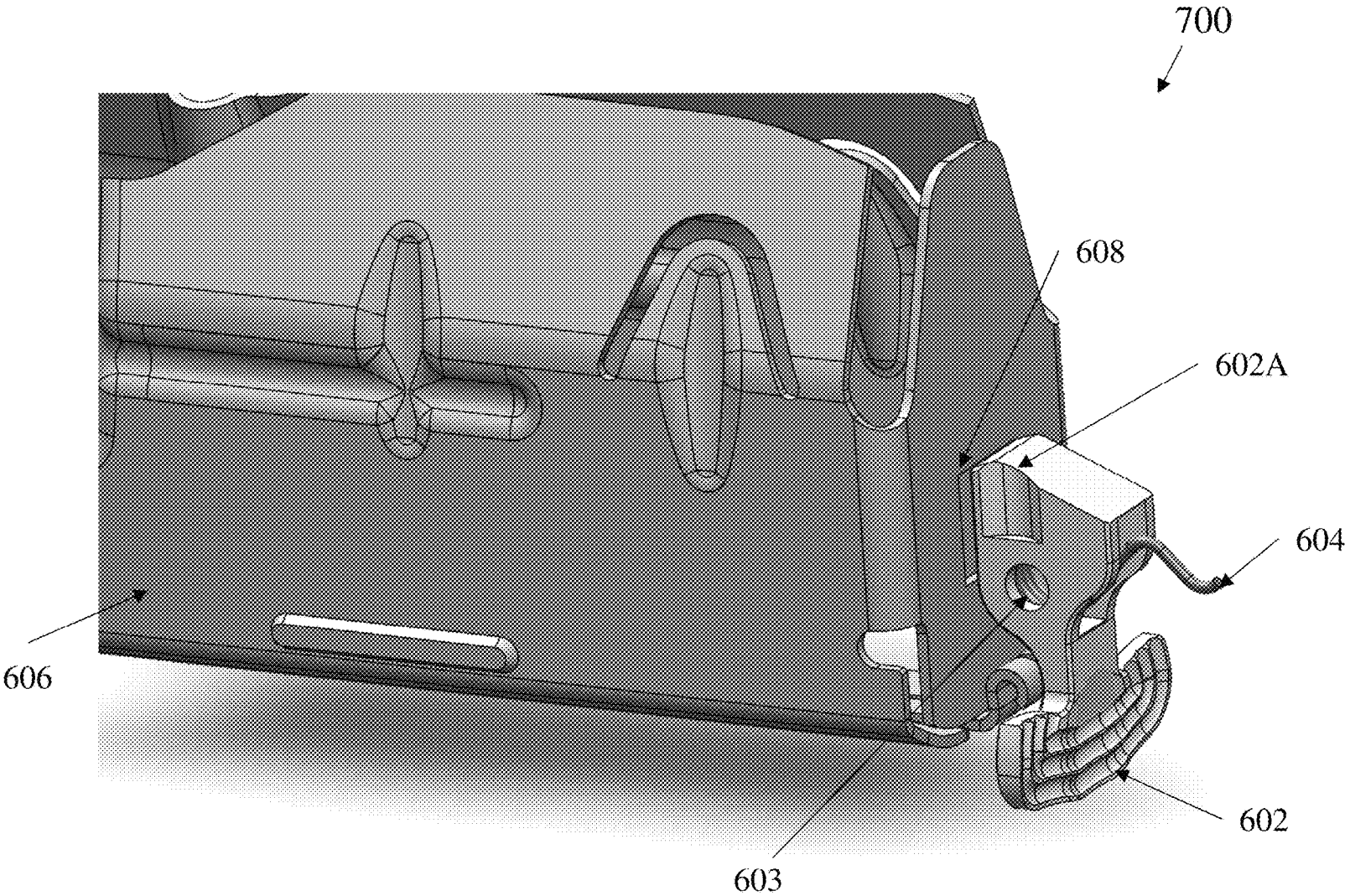
FIGS. 7A-7B show exemplary components of a rear-engaging magazine release in a second configuration that is disengaged from the magazine, according to some embodiments.
Figure 7B:
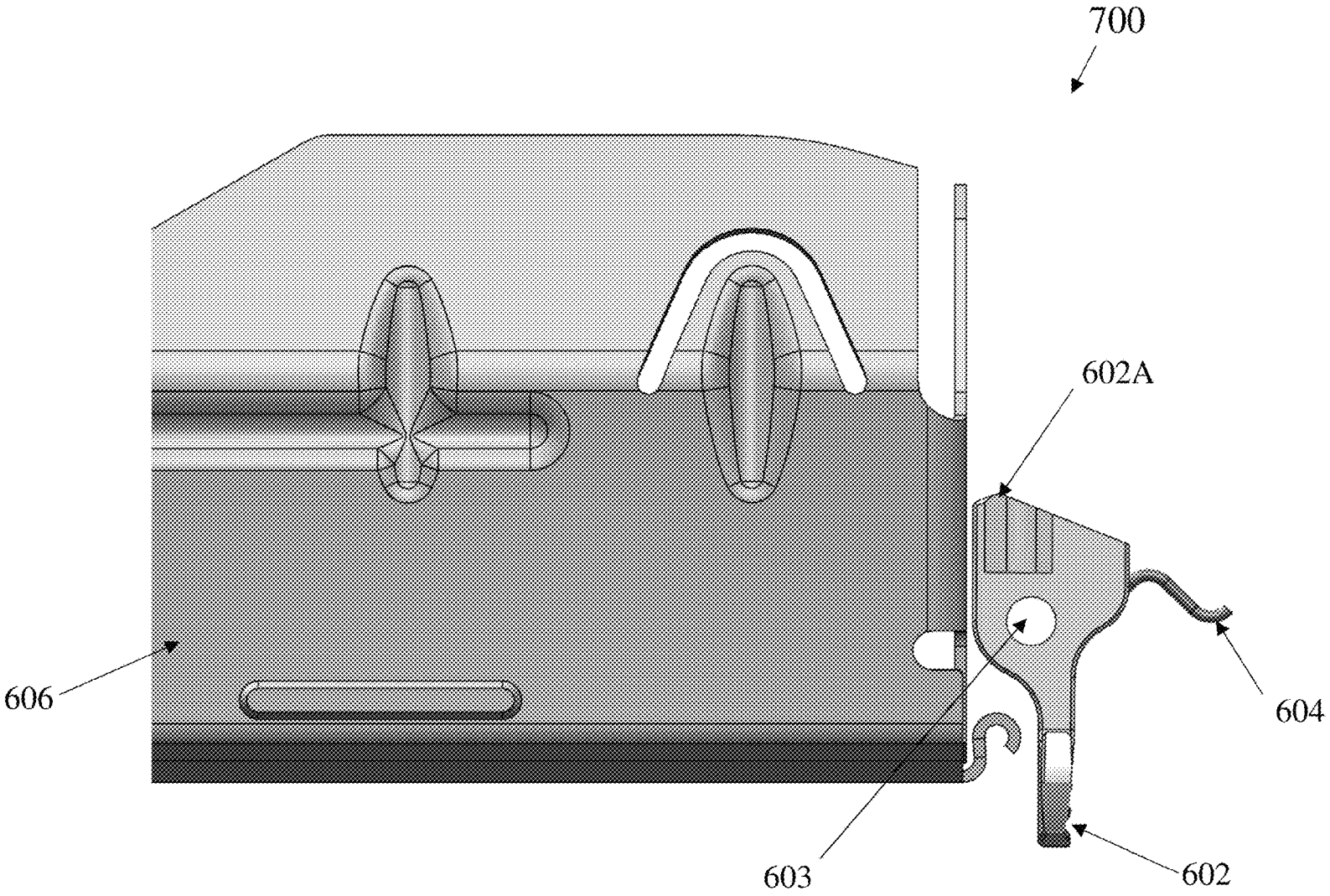

FIGS. 7A-7B show exemplary components of a rear-engaging magazine release in a second configuration 700 that is disengaged from the magazine, according to some embodiments. The second configuration 700 allows for the release of the magazine from the receiver. To achieve the second configuration 700, the user exerts a force on the release actuator 602 to push the release actuator towards the muzzle of the firearm about the fixed axis 603. Accordingly, the upper portion 602A of the release actuator 602 moves away from the magazine and out of the notch 608, disengaging the mechanical connection between the magazine 606 and the upper portion 602A of the release actuator. The magazine 606 can be spring-loaded such that the magazine 606 begins to push outwards from the receiver when the upper portion 602A is removed from the notch 608. Accordingly, when the release actuator 602 returns back to a rear-most position to return to the first configuration 700 (e.g., since the release actuator 702 is biased towards the rear-most position), the release actuator 602 will not re-engage with the magazine 606.

Figure 8:
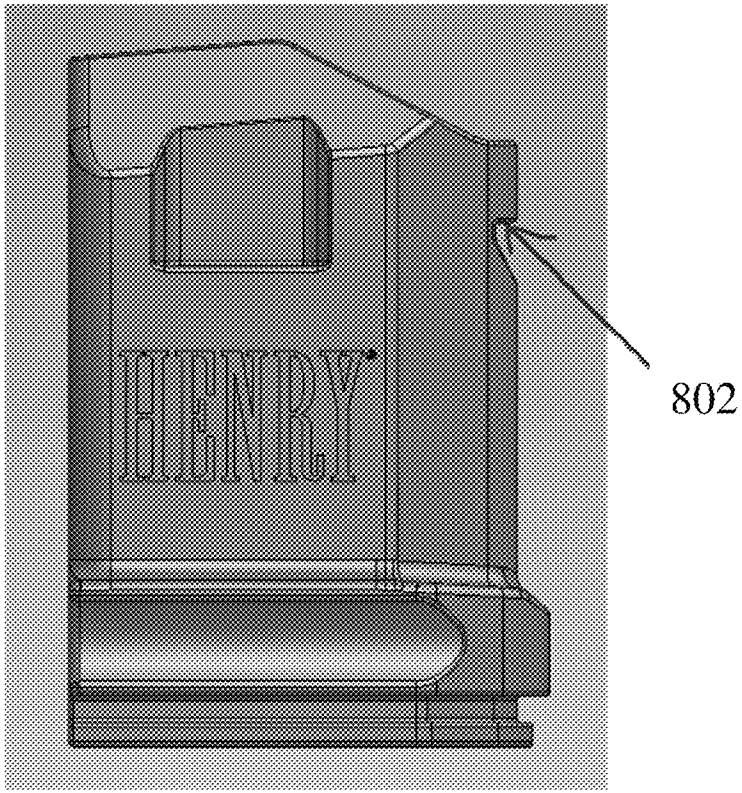
FIG. 8 is a perspective diagram of another exemplary magazine, according to some embodiments.

It should be appreciated that while some illustrative examples describe magazine release mechanisms that engage either the side of the magazine (e.g., in conjunction with FIGS. 2A-5B) or the rear of the magazine (e.g., in conjunction with FIGS. 6A-7B), some embodiments can engage with the magazine at multiple locations. It should be further appreciated that the magazine release mechanisms can be configured to engage a front of the magazine. For example, FIG. 8 is a perspective diagram of another exemplary magazine 800, according to some embodiments. The exemplary magazine 800 includes a notch 802 in the front of the magazine when inserted into the firearm (and thus, the notch is towards the muzzle of the firearm). The magazine release mechanisms described herein can therefore be configured to interact with the notch 802 of the magazine 800 (e.g., via a portion of a release actuator). Accordingly, for example, the magazine release mechanism can be configured to engage with the left and/or right side of the magazine, as well as with the front and/or rear of the magazine. As another example, the magazine release mechanism may be configured to engage with the magazine at one or more corners of the magazine (e.g., a corner between a front/rear of the magazine and the side of the magazine).

It has been discovered and appreciated that it can be desirable to use various types of magazines with a lever action firearm. For example, it can be desirable to use single stack magazines, double stack magazines, swept-back magazines, and/or other types of magazines with a lever action firearm. The techniques described herein provide for use of such magazines with a lever action firearm, including by using magazine catches and/or interchangeable magazine adapters.

Figure 9A:
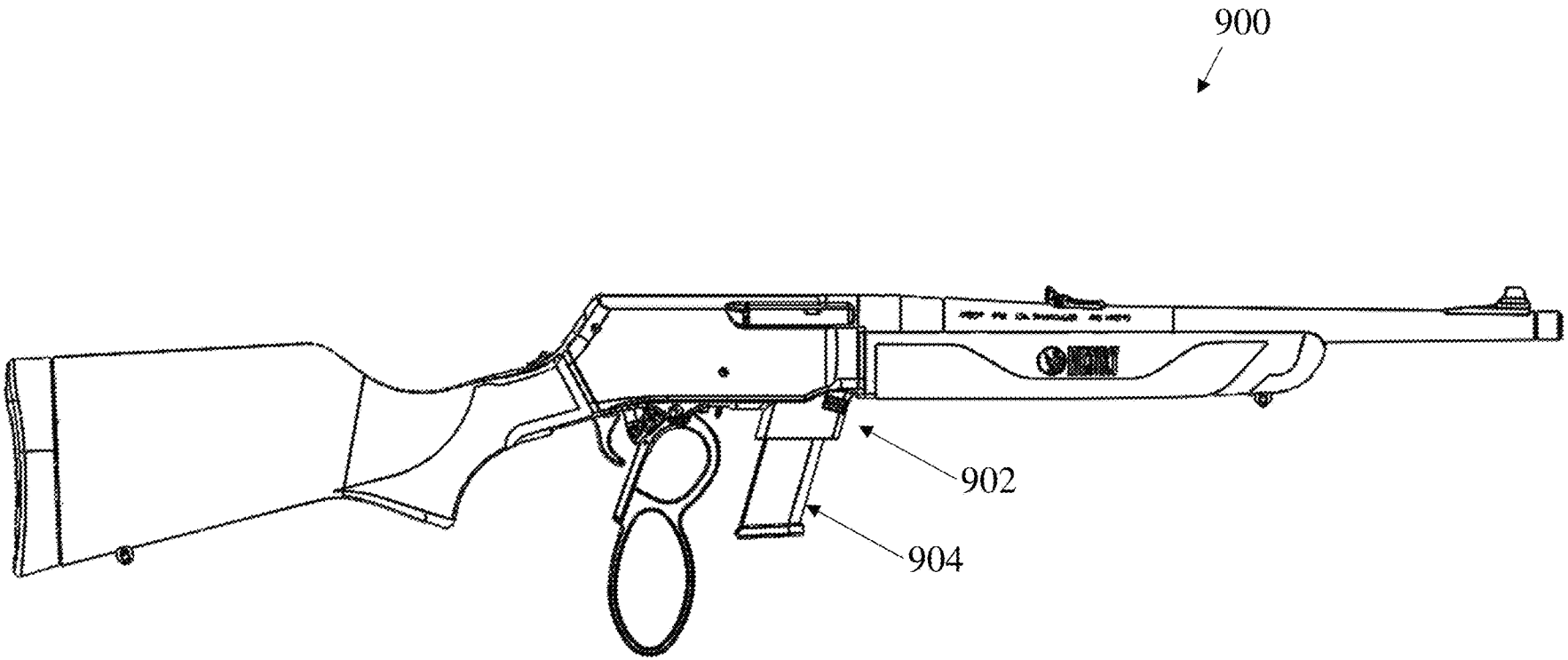
FIG. 9A shows a lever action firearm with a magazine receiver sized to accept a detachable magazine, according to some embodiments.
Figure 10A:
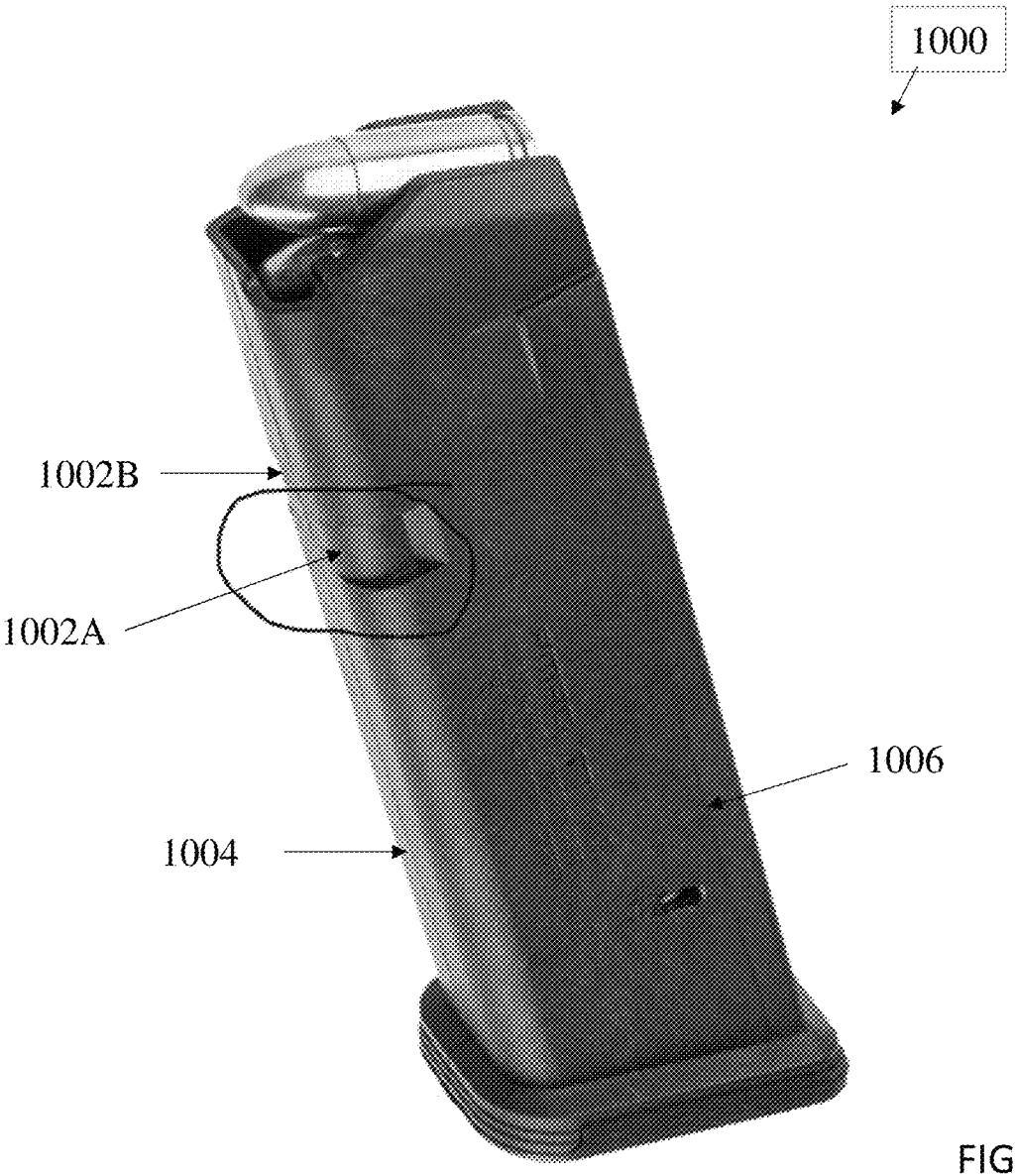
FIG. 10A shows a magazine comprising front notches, according to some examples.
Figure 10B:
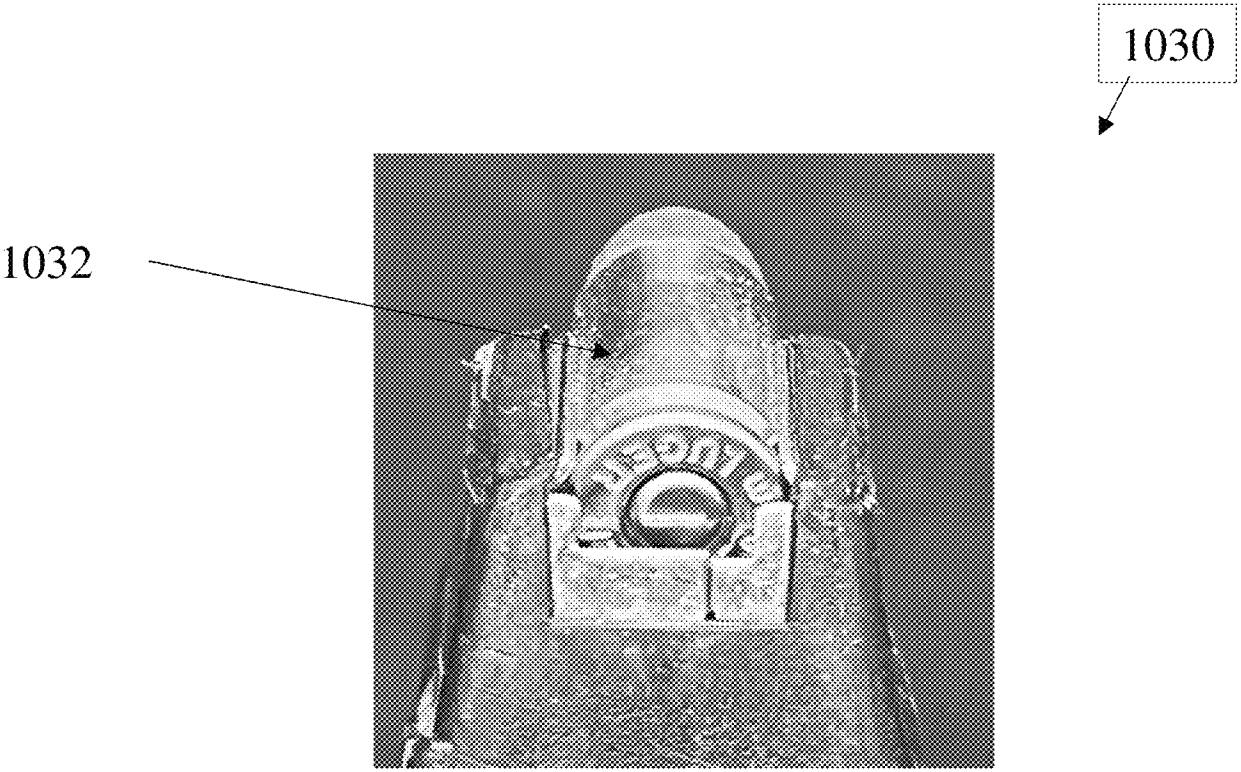
FIG. 10B shows a magazine with a single feed configuration, according to some examples.

FIG. 9A shows a lever action firearm 900 that comprises a magazine receiver 902 sized to accept a detachable magazine 904, according to some embodiments. The lever action firearm 900 can include one or more aspects as discussed above, such as those discussed in conjunction with FIGS. 1A-1C. In some embodiments, the detachable magazine 904 holds cartridges in a double stack configuration and single feeds the cartridges for firing by the lever action firearm 900. For example, FIG. 10B shows a magazine 1030 with a single feed configuration, according to some examples. As shown in FIG. 10B, a single feed configuration, the cartridge 1032 is always in a similar position when it is at the top of the magazine. As shown in FIG. 9A, the detachable magazine 904 can be loaded in the magazine receiver 902. As described herein, the lever action firearm can be configured to receive (for loading, unloading) a magazine in various ways. For example, the magazine receiver can be manufactured to receive magazines of a particular size and/or shape (e.g., single stack, double stack, etc.). As another example, the lever action firearm can include a magazine receiver that is configurable (e.g., via replaceable adapters) so that the magazine receiver can be adapted to receive different size and/or shape magazines, as discussed further below.

Figure 9B:
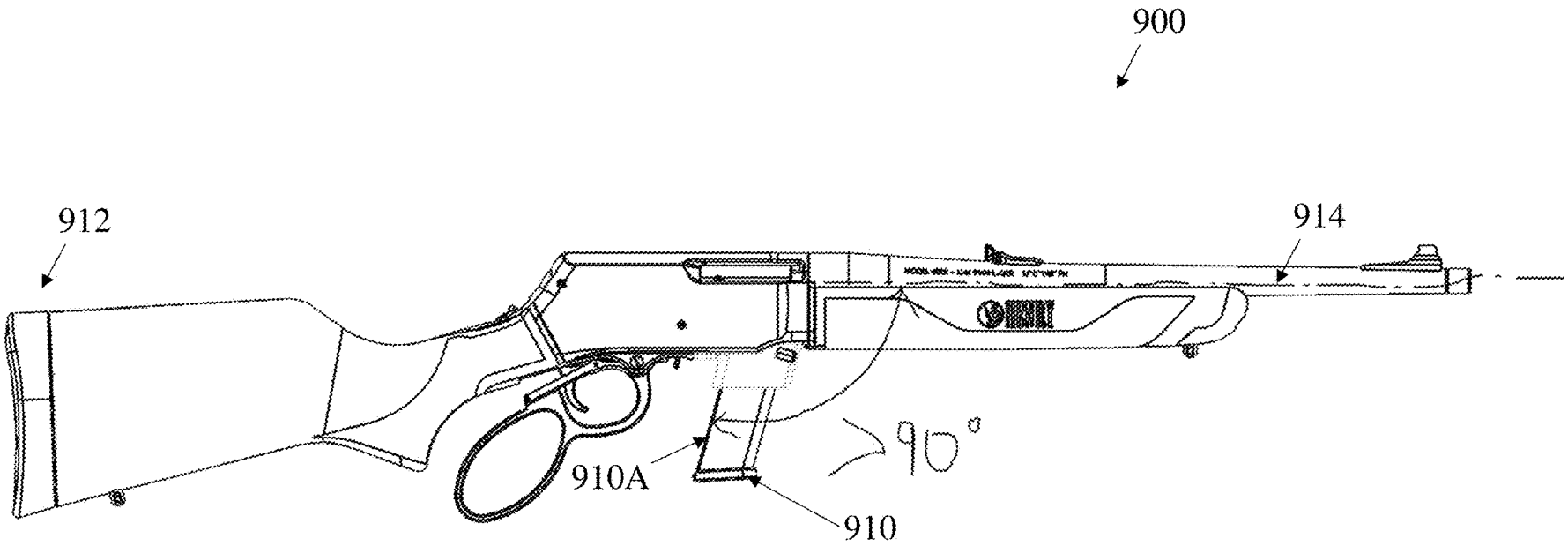
FIG. 9B shows a lever action firearm with a swept-back detachable magazine, according to some embodiments.
Figure 10C:
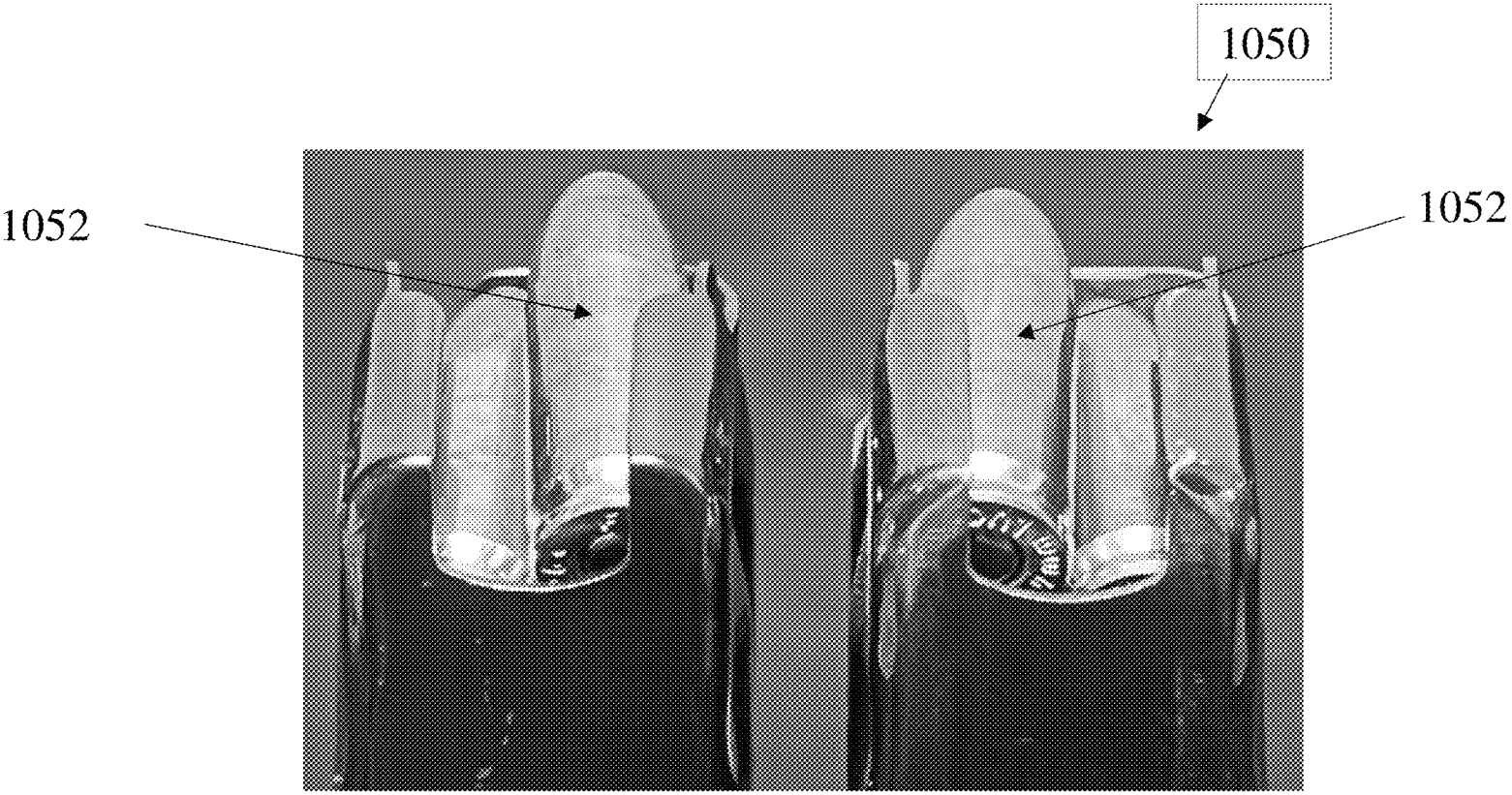
FIG. 10C shows a magazine with a double feed configuration, according to some examples.

In some embodiments, the lever action firearm 900 can be configured for use with a swept-back magazine. FIG. 9B shows a lever action firearm 900 that has a detachable magazine 910, according to some embodiments. As shown, the magazine 910 has a swept-back configuration such that the rear-facing side surface 910A, which is facing towards the butt 912 of the firearm 910 when loaded into the receiver, has an angle greater than 90 degrees with respect to an axis 914 of the bore of the firearm (e.g., a plane extending through the axis 914 of the bore of the lever action firearm). The swept-back magazine can have various configurations. For example, in some embodiments, the detachable magazine holds cartridges in a double stack configuration and single feeds the cartridges for firing by the lever action firearm. As another example, the detachable magazine holds cartridges in a double stack configuration and double feeds (feeds cartridges alternating from either side) for firing by the lever action firearm. For example, FIG. 10C shows a magazine 1050 with a double feed configuration, according to some examples. As shown, for one cycle, the cartridge 1052 is at a first position of the magazine 1050 (e.g., a right position, in this example), and then for a next cycle the cartridge is at a second position of the magazine 1050 (e.g., at a left position, in this example).

In some embodiments, the lever action firearm can be configured for use with one or more magazine adapters. The magazine adapters can allow a user to easily adjust or modify the lever action firearm to use various shapes and/or sizes of magazines, as desired. In some embodiments, the magazine receiver is configured for use with a plurality of interchangeable magazine adapters, such that each of the interchangeable magazine adapters can be used to fit the firearm with one or more different type(s) of magazines. For example, a magazine adapter can be sized to receive a detachable magazine that holds cartridges in a double stack configuration and single feeds the cartridges for firing by the lever action firearm. As another example, a magazine adapter can be sized to receive a detachable magazine that holds cartridges in a double stack configuration and double feeds the cartridges for firing by the lever action firearm.

The magazine receiver can be configured to releasably hold the magazine using various configurations. In some embodiments, the techniques described above can be used to hold the magazine, such as those discussed in conjunction with FIGS. 1A-8. However, the lever action firearm is not so limited. Magazines may include other mechanical features that can be used to engage and disengage the magazine from the firearm. For example, FIG. 10A shows a magazine 1000 comprising notches 1002A and 1002B (collectively, referred to as notches 1002), according to some examples. As shown, the notches 1002 are disposed towards a front side 1004 of the magazine 1000, which is the side that faces the muzzle of the firearm when loaded into the firearm. The magazine also includes a left side 1006 and a right side that is opposite the left side 1006 (the right side is not visible in FIG. 10A). The notches 1002 are formed from corner portions of the magazine 1000. In particular, notch 1002A is formed from portions of the front side 1004 and left side 1006, and notch 1002B is formed from the front side 1004 and the right side 1006.

In some embodiments, the lever action firearm can include a magazine receiver with an attachment mechanism that is configured to interact with a front portion of a detachable magazine to retain the detachable magazine within the magazine receiver. For example, the attachment mechanism can be configured to interact with one or both notches 1002A and 1002B shown in FIG. 10A. FIGS. 11A-11E show an example of a lever action firearm 1100 with a magazine receiver 1104 with an attachment mechanism 1102, according to some embodiments. The attachment mechanism 1102 (e.g., a magazine catch) extends across a width of the magazine receiver 1104, such that portions 1106A and 1106B are exposed at the left and right sides of the receiver 1104, respectively.

In this illustrative example, the attachment mechanism 1102 is configured to engage with notch 1002B of the releasable magazine 1000 of FIG. 10A to hold the releasable magazine 1000 within the magazine receiver 1104. The attachment mechanism 1102 includes a protrusion 1102A that fits within the notch 1002B. The attachment mechanism 1102 can be biased in the direction opposite the notch 1002B (in this example, biased towards the left side of the firearm) so that when the magazine 1000 is loaded far enough into the magazine receiver 1104, the protrusion 1102A engages with the notch 1002B. Because the attachment mechanism 1102 is biased away from the notch 1002B, the attachment mechanism 1102 secures the magazine 1000 within the magazine receiver 1104.

Figure 11A:
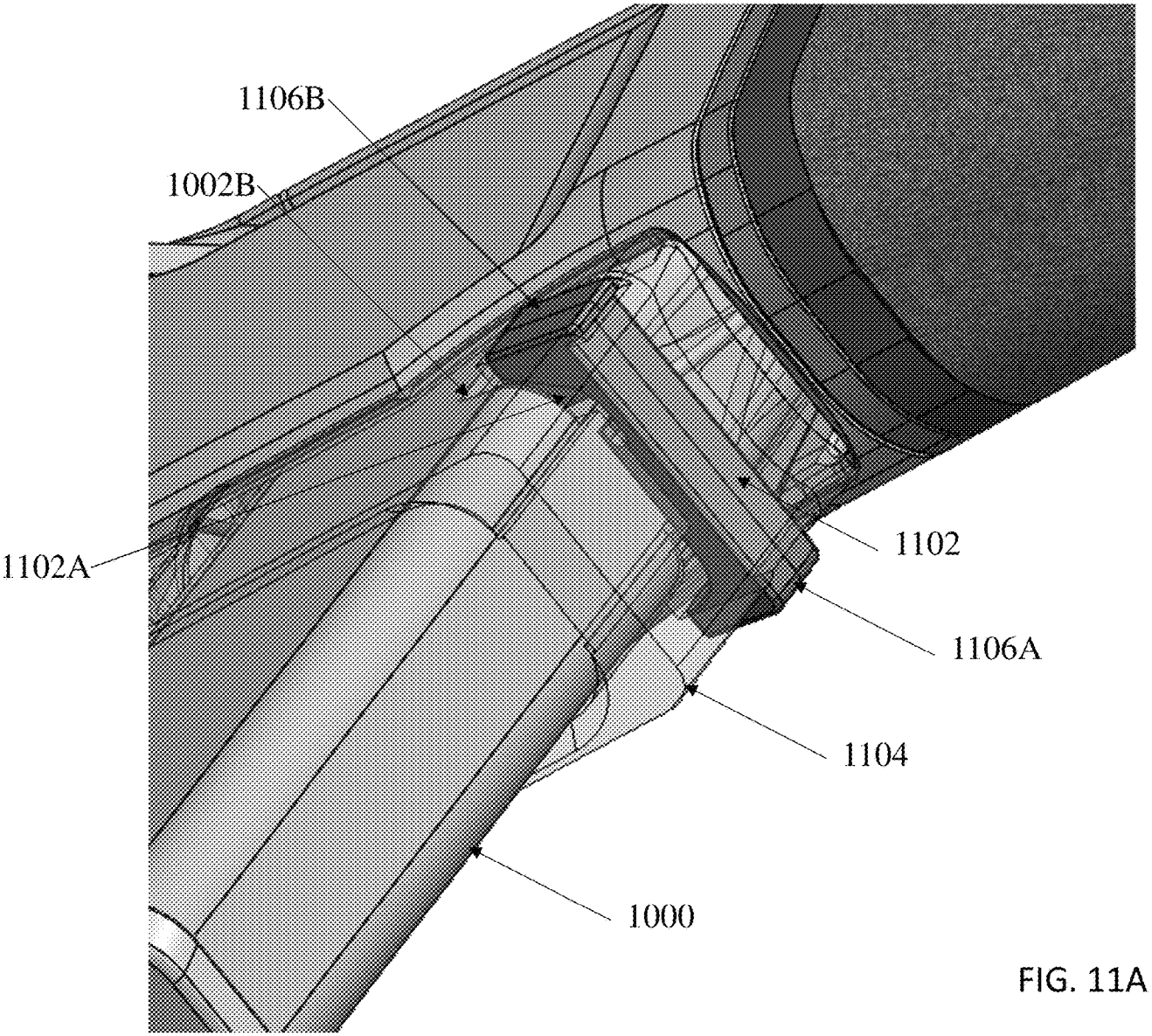
FIGS. 11A-11E show an example of a lever action firearm with a magazine receiver with an attachment mechanism, according to some embodiments.
Figure 11B:
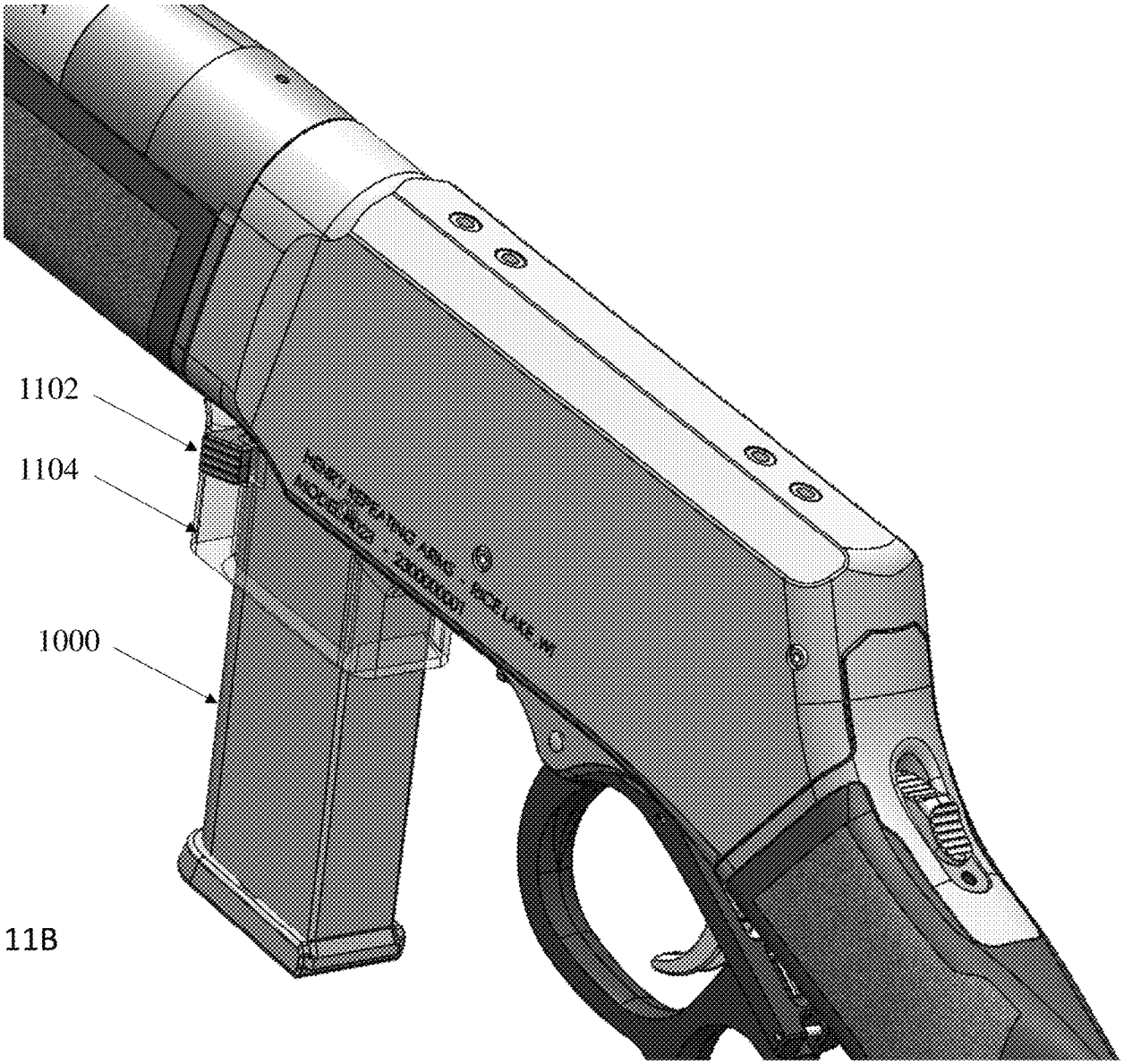
Figure 11C:
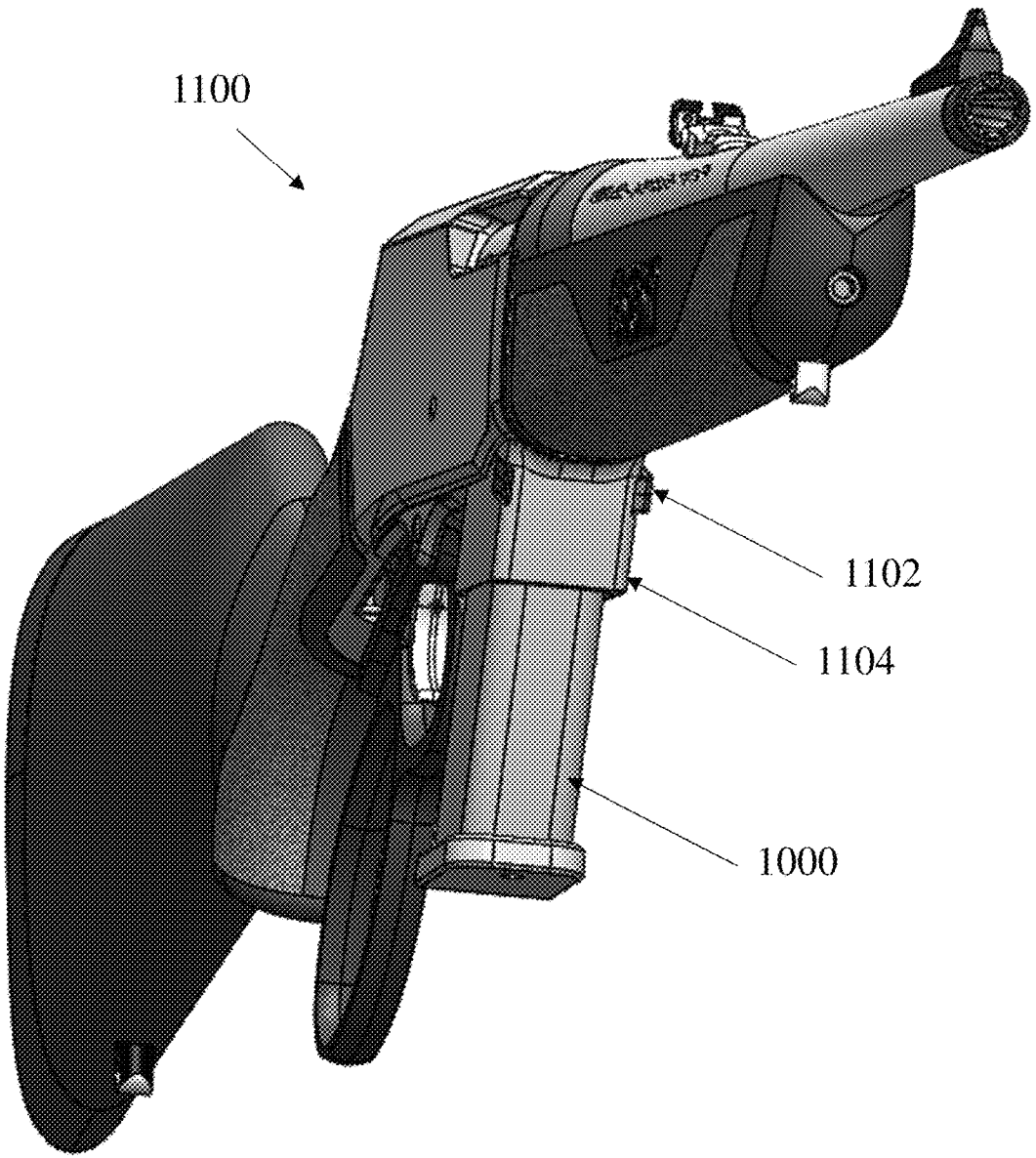
Figure 11D:
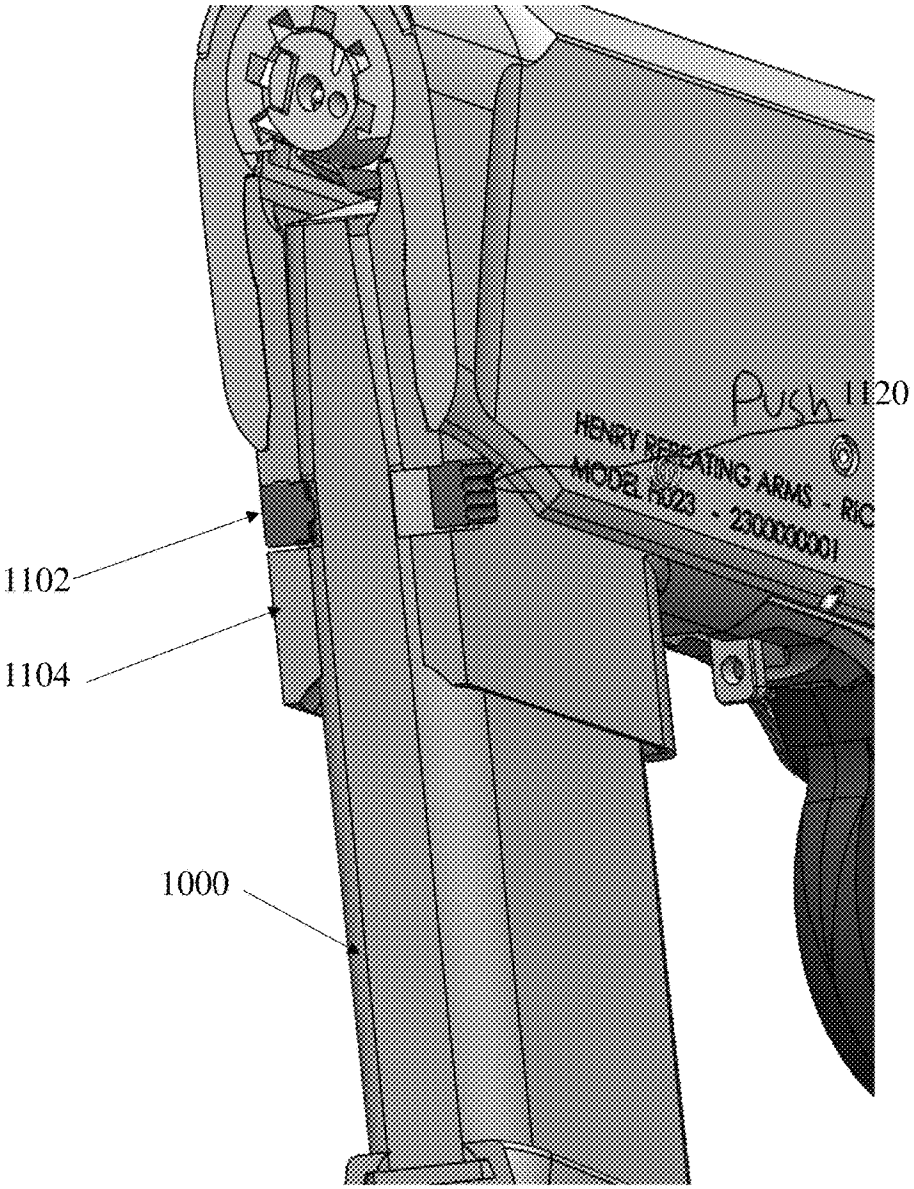
Figure 11E:
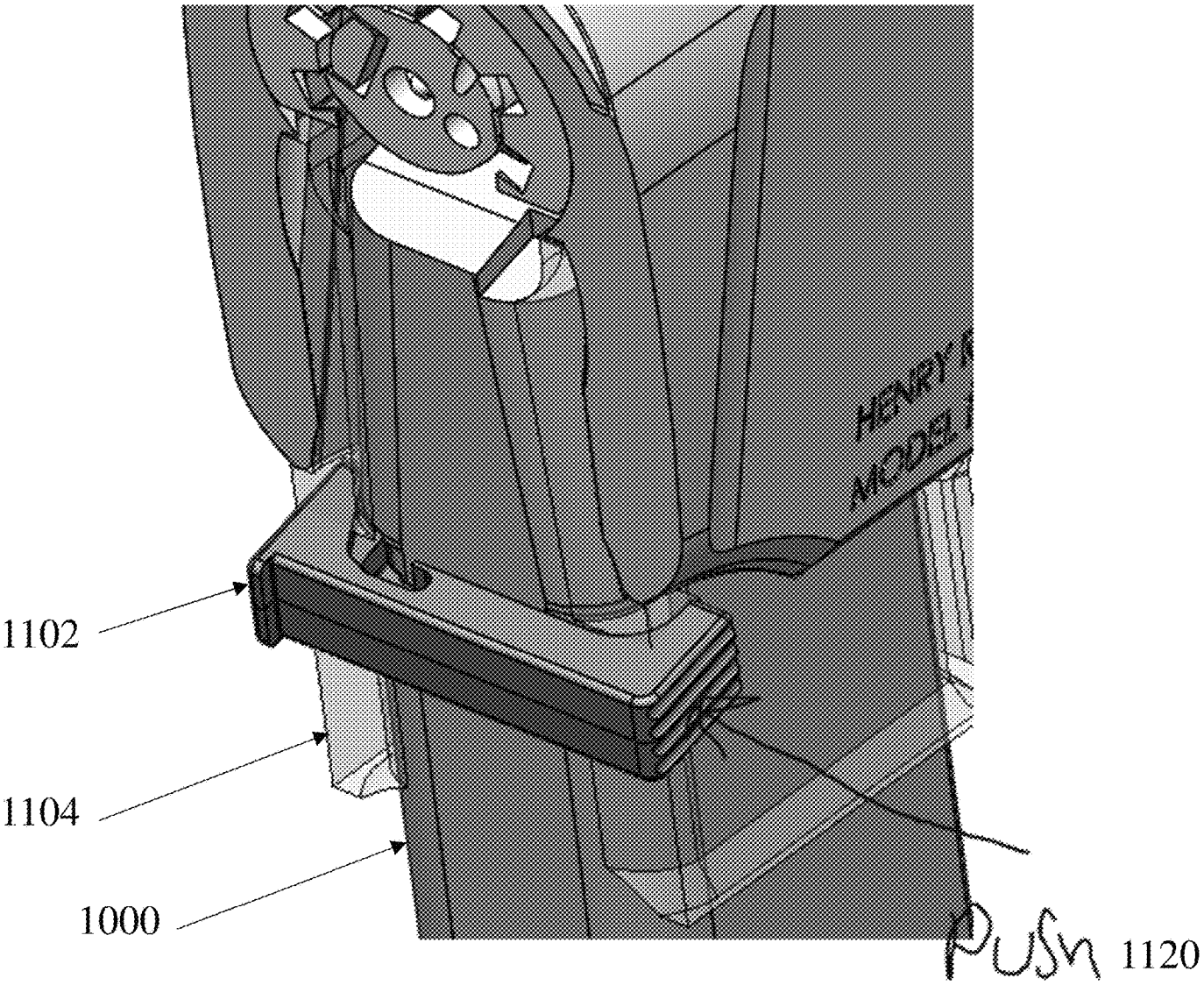

The attachment mechanism 1102 can be actuated by pushing the attachment mechanism 1102 from one side of the firearm towards the other side of the firearm. In the example shown in FIGS. 11A-11E, the attachment mechanism 1102 is pushed from the left side of the firearm 1100 to the right side of the firearm 1100, as shown in FIGS. 11D and 11E and illustrated by arrow 1120. As a result, the attachment mechanism 1102 can be actuated to disengage the protrusion 1102A from the notch 1002B of the releasable magazine 1000 to release the magazine 1000 from the magazine receiver 1104. However, it should be appreciated that this exemplary configuration is for illustrative purposes only. For example, a mirrored configuration of the attachment mechanism 1102 could be used that engages with the notch 1102A of the magazine 1000, such that the attachment mechanism 1102 is pushed from the right side of the firearm 1100 to the left side of the firearm 1100. As a result, the attachment mechanism 1102 can be configured for use by pressing the attachment mechanism 1102 at the left or right side, accordingly and as desired (e.g., to provide different configurations for left and right-handed users).

In some embodiments, one or more components of the release mechanisms described herein can be implemented as part of the magazine (e.g., instead of and/or in addition to part of the receiver or trigger guard assembly). For example, the magazine may include the release actuator, which, once the magazine is inserted into the firearm, interacts with other components of the release mechanism (e.g., notches, catches, catch plungers, and/or the like). As another example, one or more portions of the release mechanism can be provided as part of a separate component that mounts to the firearm (e.g., such that different release mechanisms can be used with the firearm as desired by the user and/or based on the magazine).

In some embodiments, the release actuator can be configured to operate in different ways and/or multiple ways. For example, in some embodiments as described herein the release actuator can be configured such that the user pushes on the release mechanism to release the magazine. In some embodiments, the release actuator can additionally or alternatively be configured so that the user pulls on the release mechanism to release the magazine. In some embodiments, the release actuator may be configured such that the user can push or pull on the release mechanism to release the magazine. Further, while the release actuator has been described herein as a lever, the techniques are not so limited and other configurations can be used, such as buttons, switches, etc.

In some embodiments, the release actuator can be disposed at different locations of the firearm. For example, rather than locating the release mechanism on the bottom of the firearm, the release mechanism can be disposed on the side of the firearm and/or at the top of the firearm. For example, the exemplary embodiments described in FIGS. 4A-5B can be used to implement a release mechanism disposed at the top of the firearm (e.g., essentially by rotating the embodiments one hundred and eighty degrees about an axis running from the muzzle of the firearm to the butt of the firearm). As another example, the exemplary embodiments can be used to implement a release mechanism disposed at the front of the firearm (e.g., essentially by rotating the embodiments one hundred and eighty degrees about an axis running from the top of the receiver (e.g., where the scope is mounted) to the bottom of the magazine. As a result, it should be appreciated that the techniques described herein can be rotated, flipped, and/or mounted at different locations of the firearm while still achieving the magazine release functionality described herein.

It should be appreciated that the techniques described herein can be used for any type of firearm, including rifles, shotguns, railguns, handguns, and/or the like. The techniques can also be used for any type of ammunition, such as caseless ammunition, electronically ignited ammunition, and/or the like.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the description provided herein be regarded as including such equivalent constructions insofar as they do not depart from the spirit and scope of the disclosed subject matter.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

Various aspects are described in this disclosure, which include, but are not limited to, the following aspects:

A1. A magazine release for a firearm, comprising:
- an arm configured to engage with a magazine on a first side of the magazine; and
- an actuator operatively coupled to the arm and configured to transition the arm from a first position to a second position when actuated, wherein in the first position the arm is engaged with the magazine to hold the magazine and in the second position the arm is disengaged from the magazine;
- wherein the actuator is configured to be accessible from both the first side of the magazine and a second side of the magazine opposite the first side.

A2. The magazine release of A1, wherein a portion of the first arm is configured to engage with a side component disposed on the first side of the magazine when the arm is in the first position and the second position.

A3. The magazine release of A2, wherein the side component is a pin.

A4. The magazine release of any of A2-A3, wherein the portion of the arm is proximate to a pivot point of the arm.

A5. The magazine release of A4, wherein:
- the pin exerts a force to the arm when the actuator is actuated to outwardly bias a front portion of the arm, to transition the arm from the first position with the front portion of the arm engaged with the magazine to hold the magazine to the second position with the front portion of the arm disengaged from the magazine.

A6. The magazine release of any of A1-A5, wherein the actuator comprises a support surface configured to engage with a magazine on a third side of the magazine perpendicular to the first and second sides of the magazine.

A7. The magazine release of A6, wherein the support surface is configured to engage with a detent disposed on the third side of the magazine.

A8. The magazine release of A7, wherein the support surface is configured to register with the detent.

A9. The magazine release of any of A1-A8, wherein the actuator is configured to be actuated by pivoting about a first axis.

A10. The magazine release of A9, wherein the actuator is configured to transition the arm from the first position to the second position by pivoting the arm about a second axis perpendicular to the first axis.

A11. The magazine release of any of A1-A10, wherein the arm is configured to be biased towards the first position.

A12. The magazine release of any of A1-A11, wherein the actuator includes a spring configured to bias the actuator towards an unactuated position such that the arm is in the first position when the actuator is in the unactuated position.

A13. A firearm, comprising the magazine release of any of A1-A12.

A14. The firearm of A13, wherein the firearm is a lever action firearm.

B1. A method of manufacturing a firearm, comprising assembling a magazine release for the firearm, the magazine release comprising:
- an arm configured to engage with a magazine on a first side of the magazine; and
- an actuator operatively coupled to the arm and configured to transition the arm from a first position to a second position when actuated, wherein in the first position the arm is engaged with the magazine to hold the magazine and in the second position the arm is disengaged from the magazine;
- wherein the actuator is configured to be accessible from both the first side of the magazine and a second side of the magazine opposite the first side.

C1. A method of releasing a magazine from a firearm, comprising:
- actuating an actuator of a magazine release of the firearm, wherein the actuator is operatively coupled to an arm configured to engage with a magazine on a first side of the magazine, to move the arm from a first position to a second position, wherein:
  - in the first position the arm is engaged with the magazine to hold the magazine and in the second position the arm is disengaged from the magazine; and
  - wherein the actuator is configured to be accessible from both the first side of the magazine and a second side of the magazine opposite the first side.

D1. A lever action firearm, comprising:
- a magazine receiver sized to accept a detachable magazine that holds cartridges in a double stack configuration and single feeds the cartridges for firing by the firearm.

D2. The lever action firearm of D1, further comprising the detachable magazine loaded in the magazine receiver.

E1. A lever action firearm, comprising:

a magazine receiver sized to accept a detachable magazine that, when loaded in the magazine receiver, comprises a swept-back configuration such that a surface of a rear-facing side of the detachable magazine comprises an angle greater than 90 degrees with respect to a plane extending through an axis of a bore of the lever action firearm.

E2. The lever action firearm of E1, wherein the detachable magazine holds cartridges in a double stack configuration and single feeds the cartridges for firing by the lever action firearm.

E3. The lever action firearm of any of E1-E2, wherein the detachable magazine holds cartridges in a double stack configuration and double feeds the cartridges for firing by the lever action firearm.

F1. A lever action firearm, comprising:

a magazine receiver configured to accept a plurality of interchangeable magazine adapters, wherein each of the interchangeable magazine adapters allows a different type of magazine to be loaded into the firearm compared to the other interchangeable magazine adapters.

F2. The lever action firearm of F1, wherein a first interchangeable magazine adapter is sized to receive a detachable magazine that holds cartridges in a double stack configuration and single feeds the cartridges for firing by the lever action firearm.

F3. The lever action firearm of any of F1-F2, wherein a first interchangeable magazine adapter is sized to receive a detachable magazine holds cartridges in a double stack configuration and double feeds the cartridges for firing by the lever action firearm.

G1. A lever action firearm, comprising:

a magazine receiver comprising an attachment mechanism configured to interact with a front portion of a detachable magazine to retain the detachable magazine within the magazine receiver.

G2. The lever action firearm of G1, wherein the front portion of the detachable magazine comprises a front corner of the detachable magazine.

H1. A lever action firearm, comprising:

a magazine receiver comprising a magazine catch, wherein:

the magazine catch is configured to engage with a portion of a releasable magazine to hold the releasable magazine within the magazine receiver; and the magazine catch can be actuated to disengage from the portion of the releasable magazine to release the releasable magazine from the magazine receiver.

H2. The lever action firearm of H1, wherein the portion of the releasable magazine that is engaged with the magazine catch comprises a notch in a side of the releasable magazine.

H3. The lever action firearm of H2, wherein:

the side of the notch is a right side of the releasable magazine; and the magazine catch is actuated by pushing the magazine catch from a left side to the right side to disengage the magazine catch from the notch of the releasable magazine.

H4. The lever action firearm of any of H2-H3, wherein:

the side of the notch is a left side of the releasable magazine; and the magazine catch is actuated by pushing the magazine catch from a right side to the left side to disengage the magazine catch from the notch of the releasable magazine.

What is claimed is:

1. A magazine release for a firearm, comprising:

an arm configured to engage with a magazine on a first side of the magazine; and an actuator operatively coupled to the arm and configured to transition the arm from a first position to a second position when actuated, wherein in the first position the arm is engaged with the magazine to hold the magazine and in the second position the arm is disengaged from the magazine;

wherein the actuator is configured to be accessible from both the first side of the magazine and a second side of the magazine opposite the first side.

2. The magazine release of claim 1, wherein a portion of the arm is configured to engage with a side component disposed on the first side of the magazine when the arm is in the first position and the second position.

3. The magazine release of claim 2, wherein the side component is a pin.

4. The magazine release of claim 2, wherein the portion of the arm is proximate to a pivot point of the arm.

5. The magazine release of claim 3, wherein:

the pin exerts a force to the arm when the actuator is actuated to outwardly bias a front portion of the arm, to transition the arm from the first position with the front portion of the arm engaged with the magazine to hold the magazine to the second position with the front portion of the arm disengaged from the magazine.

6. The magazine release of claim 1, wherein the actuator comprises a support surface configured to engage with the magazine on a third side of the magazine perpendicular to the first side and the second side of the magazine.

7. The magazine release of claim 6, wherein the support surface is configured to engage with a detent disposed on the third side of the magazine.

8. The magazine release of claim 7, wherein the support surface is configured to register with the detent.

9. The magazine release of claim 1, wherein the actuator is configured to be actuated by pivoting about a first axis.

10. The magazine release of claim 9, wherein the actuator is configured to transition the arm from the first position to the second position by pivoting the arm about a second axis perpendicular to the first axis.

11. The magazine release of claim 1, wherein the arm is configured to be biased towards the first position.

12. The magazine release of claim 1, wherein the actuator includes a spring configured to bias the actuator towards an unactuated position such that the arm is in the first position when the actuator is in the unactuated position.

13. The firearm of claim 1, wherein the firearm comprises a lever action firearm, comprising:

a magazine receiver sized to accept a detachable magazine that holds cartridges in a double stack configuration and single feeds the cartridges for firing by the firearm.

14. The firearm of claim 1, wherein the firearm comprises a lever action firearm, comprising:

a magazine receiver sized to accept a detachable magazine that, when loaded in the magazine receiver, comprises a swept-back configuration such that a surface of a rear-facing side of the detachable magazine comprises an angle greater than 90 degrees with respect to a plane extending through an axis of a bore of the lever action firearm.

15. The lever action firearm of claim 14, wherein the detachable magazine holds cartridges in a double stack configuration and:

single feeds the cartridges for firing by the lever action firearm; or double feeds the cartridges for firing by the lever action firearm.

16. The firearm of claim 1, wherein the firearm comprises a lever action firearm, comprising:

a magazine receiver configured to accept a plurality of interchangeable magazine adapters, wherein each of the interchangeable magazine adapters allows a different type of magazine to be loaded into the firearm compared to the other interchangeable magazine adapters.

17. The lever action firearm of claim 16, wherein a first interchangeable magazine adapter is sized to receive a detachable magazine that holds cartridges in a double stack configuration and:

single feeds the cartridges for firing by the lever action firearm; or double feeds the cartridges for firing by the lever action firearm.

18. The firearm of claim 1, wherein the firearm comprises a lever action firearm, comprising:

a magazine receiver comprising an attachment mechanism configured to interact with a front portion of a detachable magazine to retain the detachable magazine within the magazine receiver, wherein the front portion of the detachable magazine comprises a front corner of the detachable magazine.

19. The firearm of claim 1, wherein the firearm comprises a lever action firearm, comprising:

a magazine receiver comprising a magazine catch, wherein:

the magazine catch is configured to engage with a portion of a releasable magazine to hold the releasable magazine within the magazine receiver, wherein the portion of the releasable magazine that is engaged with the magazine catch comprises a notch in a side of the releasable magazine; and the magazine catch can be actuated to disengage from the portion of the releasable magazine to release the releasable magazine from the magazine receiver, wherein:

if the side of the notch is a right side of the releasable magazine, the magazine catch is actuated by pushing the magazine catch from a left side to the right side to disengage the magazine catch from the notch of the releasable magazine; or if the side of the notch is a left side of the releasable magazine, the magazine catch is actuated by pushing the magazine catch from a right side to the left side to disengage the magazine catch from the notch of the releasable magazine.

20. A method of manufacturing a firearm, comprising assembling a magazine release for the firearm, the magazine release comprising:

an arm configured to engage with a magazine on a first side of the magazine; and an actuator operatively coupled to the arm and configured to transition the arm from a first position to a second position when actuated, wherein in the first position the arm is engaged with the magazine to hold the magazine and in the second position the arm is disengaged from the magazine;

wherein the actuator is configured to be accessible from both the first side of the magazine and a second side of the magazine opposite the first side.

* * * * *